US010106295B2

(12) United States Patent
Lockwood

(10) Patent No.: US 10,106,295 B2
(45) Date of Patent: Oct. 23, 2018

(54) STACKED CATHETER TRAY, SYSTEM, AND ASSOCIATED METHODS

(75) Inventor: Robert Allen Lockwood, Libertyville, IL (US)

(73) Assignee: Medline Industries, Inc., Northfield, IL (US)

( * ) Notice: Subject to any disclaimer, the term of this patent is extended or adjusted under 35 U.S.C. 154(b) by 1510 days.

(21) Appl. No.: 12/785,064

(22) Filed: May 21, 2010

(65) Prior Publication Data

US 2011/0284410 A1 Nov. 24, 2011

(51) Int. Cl.
*B65D 21/02* (2006.01)
*B65D 1/36* (2006.01)

(52) U.S. Cl.
CPC ..... *B65D 21/0202* (2013.01); *B65D 1/36* (2013.01); *B65D 21/0204* (2013.01)

(58) Field of Classification Search
CPC ... B65D 1/36; B65D 21/0202; B65D 21/0204
USPC ..... 206/364, 558; 53/492
See application file for complete search history.

(56) References Cited

U.S. PATENT DOCUMENTS

| | | | |
|---|---|---|---|
| 2,659,485 | A | 11/1953 | Duley et al. |
| 2,715,296 | A | 8/1955 | Petit |
| 2,781,611 | A | 2/1957 | Bill |
| 2,886,316 | A | 5/1959 | Ayala |
| 2,947,415 | A | 8/1960 | Garth |
| 2,954,642 | A | 10/1960 | Jackson |
| 2,959,891 | A | 11/1960 | Barnett et al. |
| 3,013,656 | A | 12/1961 | Murphy, Jr. |
| 3,107,786 | A | 10/1963 | Adelman |
| 3,133,635 | A | 5/1964 | Morris |
| 3,166,189 | A | 1/1965 | Disston |
| 3,315,802 | A | 4/1967 | Maro |

(Continued)

FOREIGN PATENT DOCUMENTS

| | | |
|---|---|---|
| CN | 201823147 | 5/2011 |
| JP | 2007-229520 | 9/2007 |

(Continued)

OTHER PUBLICATIONS

Poon, Robert "Final Office Action", U.S. Appl. No. 12/846,675, filed Jul. 29, 2010; Mailed Sep. 26, 2012.

(Continued)

*Primary Examiner* — Peter S Vasat
(74) *Attorney, Agent, or Firm* — Philip H. Burrus, IV

(57) ABSTRACT

A tray stack (100) for accommodating a catheter assembly (1400) and medical devices (1401,1402,1403,1404,1409, 1410, 1411,1412,1413) corresponding to catheter use includes a first tray (101) and second tray (102). Each tray (101,102) includes a tray opening, a base member (205,206), and sidewalls (203,204). When placed atop each other, they first tray (101) and second tray (102) form a tray stack (100). When unstacked and placed in a side-by-side, single layer catheter tray assembly (200), implements disposed therein can be arranged in a predetermined sequence corresponding to an order of use during a catheterization procedure. Mechanical couplings (300) can be included to permit the trays to translate with respect to each other. Retention mechanisms (710-713) can be included to hold the trays together.

10 Claims, 9 Drawing Sheets

(56) References Cited

U.S. PATENT DOCUMENTS 3,329,261 A * 7/1967 Serany, Jr. ..... A61M 25/002 206/229
D209,641 S 12/1967 Goldberg
3,379,339 A 4/1968 Asenbauer
3,485,352 A 12/1969 Pilger
D218,077 S 7/1970 Gabriel
3,542,019 A 11/1970 Gittins
3,726,281 A 4/1973 Norton
3,770,119 A 11/1973 Hultberg et al.
3,851,649 A 12/1974 Villari
D234,404 S 2/1975 Merril
D237,315 S 10/1975 Nowakowski
D237,317 S 10/1975 Norkowski
3,967,728 A 7/1976 Gordon et al.
3,976,195 A 8/1976 Cohen
3,978,983 A 9/1976 Brezetta
D242,654 S 12/1976 Rawls
3,998,221 A 12/1976 Collins
D243,798 S 3/1977 Swartz
4,011,944 A 3/1977 Cooley
4,053,280 A 10/1977 Salisbury
4,075,782 A 2/1978 Neuschatz
D248,871 S 8/1978 Forsman et al.
D249,362 S 9/1978 Forsman et al.
4,140,127 A 2/1979 Cianci et al.
4,160,505 A 7/1979 Rauschenberger
4,170,300 A 10/1979 Pick
4,226,328 A 10/1980 Beddow
4,266,669 A 5/1981 Watson
4,282,678 A 8/1981 Tsui
4,307,539 A 12/1981 Klein
D262,995 S 2/1982 Gaba et al.
D268,130 S 3/1983 Easton
4,458,705 A 7/1984 Cawood
D275,886 S 10/1984 Sheward et al.
D276,462 S 11/1984 Villarreal
D277,508 S 2/1985 Clair
4,501,363 A 2/1985 Isbey, Jr.
4,523,679 A 6/1985 Paikoff et al.
4,530,349 A 7/1985 Metzger
D280,663 S 9/1985 Albon et al.
D280,933 S 10/1985 McLaughlin
D283,051 S 3/1986 Fichera
D287,760 S 1/1987 Discko, Jr.
4,761,008 A 8/1988 Huggins
4,767,008 A 8/1988 Warnecke et al.
4,795,441 A 1/1989 Bhatt
4,811,847 A 3/1989 Reif
4,828,113 A 5/1989 Friedland et al.
4,844,259 A 7/1989 Glowczewskie et al.
4,858,821 A 8/1989 Bickelhaupt
D310,896 S 9/1990 Winjum
4,991,877 A 2/1991 Lieberman
5,007,535 A 4/1991 Meseke et al.
5,024,326 A 6/1991 Sandel et al.
5,031,768 A 7/1991 Fischer
5,094,621 A 3/1992 Friedel
5,163,557 A 11/1992 Sokolowski
5,170,804 A 12/1992 Glassman
5,197,885 A 3/1993 Friedel
D334,973 S 4/1993 Valentine et al.
D337,830 S 7/1993 Coyne et al.
5,232,369 A 8/1993 Mavrikis
5,244,394 A 9/1993 Serabian-Musto
D343,687 S 1/1994 Houghton et al.
5,312,287 A 5/1994 Chuang
5,314,339 A 5/1994 Aponte
5,318,543 A 6/1994 Ross et al.
5,324,201 A 6/1994 Friedel
5,339,955 A 8/1994 Horan et al.
D351,661 S 10/1994 Fischer
5,392,918 A 2/1995 Harrison
5,411,437 A 5/1995 Weber et al.
5,487,566 A 1/1996 Hedge, Jr.
D380,272 S 6/1997 Partika et al.
5,665,945 A 9/1997 Oshima
D387,177 S 12/1997 Davis
D387,559 S 12/1997 Williamson
5,713,778 A 2/1998 Radosevich et al.
5,720,502 A 2/1998 Cain
5,778,574 A 7/1998 Reuben
5,779,053 A 7/1998 Partika
5,795,213 A 8/1998 Goodwin
5,810,738 A * 9/1998 Thomas, II ..... A61B 5/0215 600/486
5,820,441 A 10/1998 Pracas
5,827,262 A 10/1998 Neftel et al.
5,829,790 A 11/1998 Phillips
5,931,303 A 8/1999 Salvadori
5,941,241 A 8/1999 Weinstein et al.
5,947,284 A 9/1999 Foster
5,954,369 A 9/1999 Seabrook
5,975,295 A 11/1999 Diamond
6,004,136 A 12/1999 Ehrenpreis
6,012,586 A 1/2000 Misra
6,068,121 A 5/2000 McGlinch
6,089,943 A 7/2000 Lo
6,142,152 A 11/2000 Gawarecki
6,158,437 A 12/2000 Vagley
6,159,017 A 12/2000 Coomansingh
D442,697 S 5/2001 Hajianpour
D450,130 S 11/2001 Goldstein
D450,391 S 11/2001 Hunt et al.
6,330,427 B1 12/2001 Tabachnik
6,361,396 B1 3/2002 Snyder et al.
6,382,212 B1 5/2002 Borchard
6,405,863 B1 6/2002 Dhindsa
6,454,097 B1 9/2002 Blanco
6,579,271 B1 6/2003 Aruffo et al.
6,659,506 B1 12/2003 Erisalu
6,681,933 B1 1/2004 Demsien et al.
6,769,546 B2 8/2004 Busch
D495,491 S 9/2004 Ramirez
6,793,078 B2 9/2004 Roshdy
6,840,379 B2 1/2005 Franks-Farah et al.
6,896,141 B2 5/2005 McMichael et al.
6,915,901 B2 7/2005 Feinberg
6,926,708 B1 8/2005 Franks-Farah et al.
6,948,742 B2 9/2005 Buck
7,048,120 B2 5/2006 Pond
7,066,328 B2 6/2006 Pulsifer
D530,920 S 10/2006 Snell
D547,064 S 7/2007 Snell
D549,454 S 8/2007 .Ang.hman
7,264,869 B2 9/2007 Tobita
7,278,987 B2 10/2007 Solazzo
D557,047 S 12/2007 Dretzka
D561,473 S 2/2008 Phillips et al.
D563,673 S 3/2008 Dretzka
7,401,703 B2 7/2008 McMichael
7,434,687 B2 10/2008 Itou et al.
D579,662 S 11/2008 Dretzka
D590,596 S 4/2009 Dretzka
D596,311 S 7/2009 Antons
7,624,869 B2 12/2009 Primer
D609,819 S 2/2010 Tomes et al.
D612,153 S 3/2010 Liao
7,785,312 B2 8/2010 Thorne
7,789,873 B2 9/2010 Kubalak
D638,137 S 5/2011 Gross et al.
D662,218 S 6/2012 Pittman
8,448,786 B2 5/2013 Tomes et al.
D688,461 S 8/2013 Ambrefe et al.
8,628,549 B2 1/2014 To et al.
8,631,935 B2 1/2014 Tomes et al.
8,678,190 B2 3/2014 Tomes et al.
8,708,999 B2 4/2014 Hong et al.
D708,347 S 7/2014 Lober
D708,759 S 7/2014 Heyman et al.
D720,470 S 12/2014 Lober
D720,471 S 12/2014 Angel et al.
9,084,593 B2 7/2015 Yakel et al.
D742,028 S 10/2015 Hutchison
9,283,352 B2 3/2016 Tomes et al.

(56) References Cited

U.S. PATENT DOCUMENTS

| | | | | |
|---|---|---|---|---|
| 9,522,753 | B2 | 12/2016 | Tomes et al. | |
| D779,082 | S | 2/2017 | Andre et al. | |
| D800,337 | S | 10/2017 | Daines | |
| 9,808,400 | B2 | 11/2017 | Tomes et al. | |
| 2002/0185406 | A1 | 12/2002 | Massengale | |
| 2003/0031995 | A1 | 2/2003 | Laura | |
| 2003/0038475 | A1 | 2/2003 | Stancil | |
| 2003/0075474 | A1 | 4/2003 | Moyer et al. | |
| 2003/0159966 | A1 | 8/2003 | McMichael et al. | |
| 2003/0159969 | A1 | 8/2003 | McMichael et al. | |
| 2004/0004019 | A1 | 1/2004 | Busch | |
| 2004/0055919 | A1 | 3/2004 | Rowe et al. | |
| 2004/0161732 | A1 | 8/2004 | Stump | |
| 2004/0180822 | A1 | 9/2004 | Grafton | |
| 2004/0195145 | A1 | 10/2004 | Roshdy | |
| 2004/0238391 | A1 | 12/2004 | Pond | |
| 2005/0022822 | A1 | 2/2005 | Santilli | |
| 2005/0101905 | A1 | 5/2005 | Merry | |
| 2005/0228691 | A1 | 10/2005 | Paparo | |
| 2005/0256453 | A1 | 11/2005 | Nagamatsu | |
| 2005/0285385 | A1 | 12/2005 | Bova | |
| 2006/0009742 | A1 | 1/2006 | Solazzo | |
| 2006/0011501 | A1* | 1/2006 | Itou | A61M 25/002 206/370 |
| 2006/0029912 | A1 | 2/2006 | Kearby et al. | |
| 2006/0088355 | A1 | 4/2006 | Ribi | |
| 2006/0186010 | A1 | 8/2006 | Warnack | |
| 2006/0264822 | A1 | 11/2006 | Nagamatsu | |
| 2006/0271019 | A1 | 11/2006 | Stoller | |
| 2007/0026472 | A1 | 2/2007 | Prokash et al. | |
| 2007/0060908 | A1 | 3/2007 | Webster et al. | |
| 2007/0065792 | A1 | 3/2007 | Schubarth | |
| 2007/0084742 | A1 | 4/2007 | Miller et al. | |
| 2007/0088330 | A1 | 4/2007 | House | |
| 2007/0095699 | A1 | 5/2007 | Frieze | |
| 2007/0142786 | A1 | 6/2007 | Lampropoulos | |
| 2007/0161971 | A1 | 7/2007 | House | |
| 2007/0203464 | A1 | 8/2007 | Green et al. | |
| 2007/0225687 | A1 | 9/2007 | House | |
| 2007/0299431 | A1 | 12/2007 | Jakubowski et al. | |
| 2008/0116106 | A1 | 5/2008 | Lampropoulos et al. | |
| 2008/0121553 | A1 | 5/2008 | Gobel | |
| 2008/0221515 | A1 | 9/2008 | Nagamatsu | |
| 2008/0283426 | A1 | 11/2008 | Primer et al. | |
| 2008/0283433 | A1 | 11/2008 | Primer | |
| 2009/0071854 | A1 | 3/2009 | Martin | |
| 2009/0152160 | A1 | 6/2009 | Thompson et al. | |
| 2009/0184026 | A1 | 7/2009 | Massengale et al. | |
| 2009/0194453 | A1 | 8/2009 | Thorne et al. | |
| 2009/0234346 | A1 | 9/2009 | McBride et al. | |
| 2009/0236259 | A1 | 9/2009 | Hicks | |
| 2010/0274205 | A1 | 10/2010 | Morelli et al. | |
| 2010/0307942 | A1 | 12/2010 | Tomes et al. | |
| 2010/0311026 | A1 | 12/2010 | Tomes et al. | |
| 2011/0107494 | A1 | 5/2011 | Haines | |
| 2011/0155599 | A1 | 6/2011 | Yakel et al. | |
| 2011/0284410 | A1 | 11/2011 | Lockwood | |
| 2011/0297147 | A1 | 12/2011 | Lick et al. | |
| 2012/0145589 | A1 | 6/2012 | Macinnes et al. | |
| 2014/0110296 | A1 | 4/2014 | Terzibashian | |

FOREIGN PATENT DOCUMENTS

| | | |
|---|---|---|
| WO | WO-2005/027767 | 3/2005 |
| WO | WO-2006/114466 | 11/2006 |
| WO | WO-2007/045943 | 4/2007 |

OTHER PUBLICATIONS

Poon, Robert "NonFinal Office Action", U.S. Appl. No. 13/374,509, filed Dec. 30, 2011; Mailed Oct. 2, 2012.

Poon, Robert "NonFinal Office Action", U.S. Appl. No. 13/153,300, filed Jun. 3, 2011; Mailed Oct. 1, 2012.

Poon, Robert "NonFinal OA", U.S. Appl. No. 12/495,148, filed Jun. 30, 2009; Mailed Oct. 4, 2012.

Byun, Sung C., "PCT Search Report", PCT/US2012/039311; Filed May 24, 2011; Mailed Oct. 25, 2012.

Hand, Melanie J., "NonFinal OA", U.S. Appl. No. 13/155,026, filed Jun. 7, 2011; Mailed Nov. 30, 2012.

Byun, Sung Cheal "PCT Search Report and Written Opinion", PCT/US2012/037524; Filed May 11, 2012; Mailed Nov. 16, 2012.

"EPO Intent to Grant", EPO Application No. 10251024.5; Filed Jun. 2, 2010; Mailed Nov. 2, 2012.

Poon, Robert "NonFinal Office Action", U.S. Appl. No. 12/846,675, filed Jul. 29, 2010; Mailed Dec. 22, 2011.

Poon, Robert "Non-Final Office Action", U.S. Appl. No. 12/495,148, filed Jun. 30, 2009; first inventor: Jennifer E. Tomes; mailed: Aug. 4, 2010.

Yuan, Minqiang "Non-Final Office Action", Chinese Application No. 200920267201.2, Mailed Sep. 9, 2010.

European Patent Office, "Extended EPO Search Report", EPO Application No. 10251025.2, in the Name of Medline Industries, Mailed Sep. 29, 2010.

Medline, "Medline Aritcle/Brochure", Published 2008.

Yuan, Minquiang "Non-Final Office Action", Chinese Application No. 200920267201.2, Mailed Jun. 4, 2010.

European Patent Office, "Extended EPO Search Report", Application No. 10251024.5, in the Name of Medline Industries, Mailed Oct. 18, 2010.

Examiner, Chinese Patent Office "First Office Action", mailed: Nov. 18, 2010 application 201020219785.9 Filed: Jun. 3, 2010.

Poon, Robert "Final Office Action", U.S. Appl. No. 12/495,148, filed Jun. 30, 2009, Mailed Mar. 3, 2011.

Prange, Sharon M., "Response to First Office Action", Dated: Aug. 6, 2009 U.S. Appl. No. 12/004,796 Inventor: Jonathan S. Primer et al. Filed: Dec. 21, 2007.

Poon, Robert "NonFinal Office Action", U.S. Appl. No. 12/647,515, filed Dec. 27, 2009; Mailed Jun. 28, 2012.

Cavanna, Mark "Ex Parte Quayle Action", U.S. Appl. No. 29/380,474, filed Dec. 6, 2010; Mailed Aug. 14, 2012.

Poon, Robert "Restriction Requirement", U.S. Appl. No. 12/647,515, filed Dec. 27, 2009; Mailed May 23, 2012.

Byun, Sung C., "PCT Search Report", PCT/US2011/068193; Filed Dec. 30, 2011; Mailed Aug. 22, 2012.

Cavanna, Mark "Notice of Allowance", U.S. Appl. No. 29/362,279; May 21, 2010, Mailed Sep. 19, 2011.

Cavanna, Mark "NonFinal Office Action", U.S. Appl. No. 29/380,474, filed Dec. 26, 2012; Mailed Mar. 27, 2012.

Cavanna, Mark "Notice of Allowance", U.S. Appl. No. 29/338,022, filed Jun. 3, 2009; Mailed Oct. 1, 2009.

Pass, Natalie "NonFinal OA", U.S. Appl. No. 13/153,265, filed Jun. 3, 2011; Mailed Mar. 5, 2013.

Hand, Melanie J., "Notice of Allowance", U.S. Appl. No. 13/155,026, filed Jun. 7, 2011; Mailed Feb. 1, 2013.

Poon, Robert "Final OA", U.S. Appl. No. 13/374,509, filed Dec. 30, 2011; Mailed Aug. 6, 2013.

Poon, Robert "Final OA", U.S. Appl. No. 13/153,300, filed Jun. 3, 2011; Mailed Aug. 6, 2013.

Hand, Melanie J., "NonFinal OA", U.S. Appl. No. 13/115,053, filed Jun. 7, 2011; Mailed May 9, 2013.

Poon, Robert "Final OA", U.S. Appl. No. 12/647,515, filed Dec. 27, 2009; Mailed May 13, 2013.

Pass, Natalie "Final OA", U.S. Appl. No. 13/153,265, filed Jun. 3, 2011; Mailed Jul. 12, 2013.

Poon, Robert "Final Office Action", U.S. Appl. No. 12/495,148, filed Jun. 30, 2009; Mailed Jul. 31, 2013.

Poon, Robert "NonFinal OA", U.S. Appl. No. 12/846,675, filed Jul. 29, 2010; Mailed Sep. 10, 2013.

Cavanna, Mark "Notice of Allowance", U.S. Appl. No. 29/444,526, filed Jan. 31, 2013; Mailed Oct. 17, 2013.

Hand, Melanie J., "Notice of Allowance", U.S. Appl. No. 13/155,054, filed Jun. 7, 2011; Mailed Oct. 28, 2013.

Poon, Robert "Notice of Allowance", U.S. Appl. No. 12/495,148, filed Jun. 30, 2009; Mailed Nov. 20, 2013.

(56) References Cited

OTHER PUBLICATIONS

"Instructions", Naming a character website. URL: <https://web.archive.org/web/20080410122058/http://www.wilihow.com/Make-Your-Own-Anime-or-Mange-Character>. 2008.Retreived from Internet Dec. 10, 2013.
Naming Characters on Cards website.URL:<https://web.archive.org/web/20060219171403/http://www.hubbardscupboard.org/brown_bear_brown_bear.html>. (2006) . . . Retrieved form Internet Dec. 11, 2013.
Dictionary definition m-w. URL:<http://www.merriam-webster.com/dictionary/brave>. Retrieved fro Internet Dec. 10, 2013.
Dictionary definition m-w. URL:<http://ww.merriam-webster.com/dictionary/reassure>. Retrieved from Internet Dec. 10, 2013.
Lion King Sticker website. URL: <http://tlkobession.wuffpaws.org/OldSite/games/games2.html>. 1996 Retrieved from Internet Dec. 10, 2013.
Lion Sticker Activity Book website. URL: <http://www.amazon.com/Disneys-Simbas-Pride-Sticker-Activity/dp/B0018DOJZA>. 1998 Retrieved from Internet Dec. 10, 2013.
"Examiner's Answer", U.S. Appl. No. 13/153,265, filed Jun. 3, 2011; Mailed Dec. 17, 2013.
Poon, Robert "NonFinal OA", U.S. Appl. No. 12/647,515, filed Dec. 27, 2009; Mailed Dec. 18, 2013.
Poon, Robert "Final OA", U.S. Appl. No. 12/846,675, filed Jul. 29, 2010; Mailed Dec. 18, 2013.
"Extended EPO Exam Report", EPO App No. 10251025.2; Filed Jun. 2, 2010; Mailed Dec. 17, 2013.
Poon, Robert "Notice of Allowance", U.S. Appl. No. 12/846,675, filed Jul. 29, 2010; Mailed Apr. 30, 2014.
Gimenez Burgos, R "Extended European Search Report", 11854003.8; Filed Dec. 30, 2011; Mailed Jun. 3, 2014.
"Bardex I.C. Infection Control Foley Tray", *Bard Infection Control System; Bardex I.C. Directions for Use Infection Control Foley Tray; Copyright Dated 2006*.
"Bardex I.C. Complete Care StateLock Device 350 ml Urine Meter Foley Tray with Bacteriostatic Collection System", *Bard Infection Control System; Bardex I.C. Complete Care Directions for Use; Copyright Dated Sep. 2006*.
"Bardex I.C. Infection Control 350ml Urine Meter Foley Tray", *Bard Infection Control System; Bardex I.C. Urine Meter Foley Tray Directions for Use; Copyright Dated 2006*.
"Bard Medical Division Care & Catheterization Script", *Care & Catheterization/Preventing UTI Script for education video; Preventing UTI: Care and Catheterization Techniques*; Copyright 2006; AV0512-06 R12/05 XXX.
*Medline Industries, Inc.* vs *C.R. Bard, Inc*; No. 14-cv-3618; C.R. Bard's LPR 2.3 Contentions—Initial Non-Infringement; Exhibits 1 and A-H; Dated Sep. 5, 2014.
*Medline Industries, Inc.* vs *C.R. Bard, Inc*; No. 1:14-cv-03618; Medline Industries, Inc.'s Response to C.R. Bard's Initial Invalidity Contentions; Exhibits A-H; Dated Sep. 19, 2014.
*Medline Industries, Inc.* vs *C.R. Bard, Inc*; No. 1:14-cv-3618; Responses to Medline Industries, Inc.'s First set of Requests for the Production of Documents; Dated Sep. 26, 2014.
*Medline Industries, Inc.* vs *C.R. Bard, Inc*; No. 1:14-cv-03618; Response to Medline Industries, Inc.'s First Set of Interrogatories; Dated Sep. 26, 2014.
"Publication", *European Commission: Pharmaceutical Committee "A Guideline on the Readability of the Label and Package Leaflet of Medicinal Products for Human Use*"; Dated Sep. 29, 1998.
"Bard Publication", "*A few important words about Catheter Care*"; C.R. Bard, Inc; Copyright 2001 C.R. Bard, Inc.
*Dover Intermittent Catheter Tray*—14 fr, Red Rubber; Website http://tinyurl.com/o4esrwh; Unknown Publication Date.
"YouTube Training Video", https://www.youtube.com/watch?v=ISBya_5cIM.
"YouTube Training Video", https://www.youtube.com/watch?v=YwqcRUP35nl&list =UUG7a6tFPh1wvF0QDM_Z3DarQ.
"NonFinal Office Action", U.S. Appl. No. 13/680,902, filed Apr. 11, 2014; Mailed Dec. 2, 2014.
"Inter Partes Review Petition for U.S. Pat. No. 8,448,786", U.S. Pat. No. 8,448,786; Filed Dec. 30, 2014; Mailed Dec. 30, 2014.
"Inter Partes Review Petition", IPR Exhibit—Kimmel Declaration U.S. Pat. No. 8,448,786 Patent; Dr. Robert M. Kimmel Declaration; Received Dec. 30, 2014.
"Inter Partes Review Petition", Exhibit; Kimmel CV—Dr. Robert M. Kimmel; Mailed Dec. 30, 2014.
"Inter Partes Review Petition", IPR Exhibit—Susan Carrow Declaration U.S. Pat. No. 8,448,786 patent; mailed Dec. 30, 2014.
"Inter Partes Review Petition", Exhibit; Carrow CV—Susan Carrow CV; Mailed Dec. 30, 2014.
"Inter Partes Review Petition", Exhibit; EC Guideline 2009; "Guideline on the Readability of the Labelling and Package Leaflet of Medicinal Products for Human Use"; Revision 1 Published Jan. 12, 2009 (Jan. 12, 2009); Mailed Dec. 30, 2014.
"Inter Partes Review Petition", Exhibit—EC Guideline 1998; "A Guideline on the Readability of the Label and Package Leaflet of Medicinal Products for Human Use"; Published Sep. 29, 1998 (Sep. 29, 1998); Mailed Dec. 30, 2014.
"Inter Partes Review Petition", Exhibit—Soroka Glossary_wrap; Illustrated Glossary of Packaging Terminology; second edition; publication date unknown.
"Inter Partes Review Petition", Exhibit—Soroka Glossary 'Bag'; Illustrated Glossary of Packaging Terminology, second edition; Walter Soroka; publication unknown.
"Inter Partes Review Petition", Exhibit—Encyclopedia Dictionary of Medicine, Nursing and Allied Health; Miller Keane, Seventh Edition.
"Inter Partes Review Petition", Exhibit—Dorland's Definition of Bag; Dorland's Illustrated Medical Dictionary; 31st Edition; Publication Date Unknown.
"Inter Partes Review Petition", Exhibit—Nursing Standard; Article in Learning Zone—Continue Professional Development; "Reducing the risks associated with urinary catheters"; Published Mar. 25, 2009.
"Inter Partes Review Petition", Exhibit—Websters Dictionary Definition of Dispose; Webster's Third New International Dictionary; Copyright 2003; publication date unknown.
"Inter Partes Review Petition", Exhibit—Bard DFU; Bardex Infection Control Foley Tray; Copyright 2006, publication date unknown.
"Inter Partes Review Petition", Exhibit—Medline Initial Infringement Contentions; *Medline Industries* vs. *C.R. Bard*; Dated Aug. 22, 2014.
"Inter Partes Review Petition", Exhibit—FDA Article; Guidance for the Content of Premarkt Notifications fro Conventional and Antimicrobial Foley Catheters; http://www.fda.gov/medicaldevices/deviceregulationandguidance/guidancedocuments/ucm080884.htm; Unknown Publication Date.
"Inter Partes Review Petition", Exhibit—Bardex DFU; Directions for Use/Patient Education Information—Urology; Unknown Publication Date.
"Inter Partes Review Petition", Exhibit—Mosby's Pocket Guide Excerpt; Mosby's Pocket Guide to Basic Skills and Procedures; Sixth Edition; Perry & Potter; "Urinary Catheter: Indwelling, Straight, Care and Removal"; Unknown Publication Date.
"Inter Partes Review Petition", Exhibit—Health Protection Scotland; CAUTI Maintenance Bundel; Version 2, Feb. 2008.
"Inter Partes Review Petition", Exhibit—FAQs "Catheter-Associated Urinary Tract Infection"; Unknown Publisher; Unknown Publication Date.
"Inter Partes Review Petition for U.S. Pat. No. 8,631,935", Inter Partes Review Petition for U.S. Pat. No. 8,631,935 for claims 1-4 and 11-20; Filed Dec. 30, 2014.
"Inter Partes Review Petition for U.S. Pat. No. 8,631,935", Inter Partes Review Petition for U.S. Pat. No. 8,631,935 for Claims 7-8, 10, 21-23, 25, 27-28, and 30-34; Filed Dec. 30, 2014.
"Inter Partes Review Petition for U.S. Pat. No. 8,678,190", Inter Partes Review Petition for U.S. Pat. No. 8,678,190; Filed Dec. 30, 2014.
"Inter Partes Review Petition", Exhibit—Kimmel Declaration for U.S. Pat. No. 8,631,935 claims 1-4 and 11-20; Declaration of Dr. Robert M. Kimmel; Mailed Dec. 30, 2014.

(56) References Cited

OTHER PUBLICATIONS

"Inter Partes Review Petition", Exhibit—Declaration of Susan Carrow for U.S. Pat. No. 8,631,935 claims 1-4 and 11-20; Mailed Dec. 30, 2014.
"Inter Partes Review Petition", Exhibit—Response to Office Action in U.S. Appl. No. 12/495,148, filed Jun. 30, 2009; Response Filed Nov. 19, 2010.
"Inter Partes Review Petition", Exhibit—RCE Filed November May 31, 2011 for U.S. Appl. No. 12/495,148, filed Jun. 30, 2009.
"Inter Partes Review Petition", Exhibit—Amendment filed on Apr. 3, 2013 for U.S. Appl. No. 12/495,148, filed Jun. 30, 2009.
"Inter Partes Review Petition", Exhibit—Infection Control Today Article; Medical Center Cuts Catheterizations by 21 Percent with Foley Catheter Management System; Published 2010.
"Inter Partes Review Petition", Exhibit—Morning Start Article; "Floyd Medical Center Reduces Catheter-Associated Urinary Tract Infections 83 Percent and Catheter Use by 23 Percent"; Published Jan. 2011.
"Inter Partes Review Petition", Exhibit—Medical News Today Article; Getting to Zero: Medlines' Erase Cauti Program Helps Hospitals Reduce Catheter Use by 20 Percent; Article Date Apr. 13, 2011.
"Inter Partes Review Petition", Exhibit—The Journal of Healthcare Contracting, Oct. 2012; "Catheter-associated urinary tract infections".
"Inter Partes Review Petition", IPR Exhibit—Kimmel Declaration for U.S. Pat. No. 8,631,935 claims 1-4 and 11-20; Declaration of Dr. Robert M. Kimmel; Mailed Dec. 30, 2014.
"Inter Partes Review Petition", IPR Exhibit—Carrow Declaration for U.S. Pat. No. 8,631,935 claims 1-4 and 11-20; Susan Carrow Declaration; Mailed Dec. 30, 2014.
"Inter Partes Review Petition", IPR Exhibit—Kimmel Declaration for U.S. Pat. No. 8,631,935 claims 7-8, 10, 21-23, 25, 27-28, and 30-34; Declaration of Dr. Robert M. Kimmel; Mailed Dec. 30, 2014.
"Inter Partes Review Petition", IPR Exhibit—Kimmel Declaration for U.S. Pat. No. 8,768,190; Declaration of Dr. Robert M. Kimmel; Mailed Dec. 30, 2014.
"Inter Partes Review Petition", IPR Exhibit—Carrow Declaration for U.S. Pat. No. 8,768,190; Declaration of Susan Carrow; Mailed Dec. 30, 2014.
Poon, Robert "NonFinal OA", U.S. Appl. No. 14/265,909, filed Apr. 30, 2014; Mailed Dec. 31, 2014.
Poon, Robert "NonFinal OA", U.S. Appl. No. 14/265,920, filed Apr. 30, 2014; Mailed Dec. 30, 2014.
Gimenez Burgos, R "European Examination Report", European Application No. 11 854 003.8-1659; Mailed Jan. 22, 2015.
Gimenez Burgos, R "Extended European Search Report", EPO App No. 1279 3939; Mailed Jan. 27, 2015.
Gimenez Burgos, R "Extended European Search Report", EU App No. 12792423.1-1659/2713933; PCT/US2012039311; Mailed Jan. 27, 2015.
"Bard IPR Exhibit", "Inter Partes Review Petition", IPR Exhibit—Carrow Declaration for U.S. Pat. No. 8,631,935; Susan Carrow Declaration; Mailed Dec. 30, 2014.
"Article 94(3) EPC Examination", European Application No. 10 251 025.2-1501; Mailed Mar. 13, 2015.
Poon, Robert "Final OA", U.S. Appl. No. 12/647,515, filed Dec. 27, 2009; Mailed Apr. 7, 2015.
"Office Action", Chinese Application No. 201180066491.4; Mailed Mar. 24, 2015.
"Inter Partes Review—Patent Owner Response", Inter Partes Review—Patent Owner Response; U.S. Pat. No. 8,448,786; Filed Apr. 22, 2015.
"Inter Partes Review—Patent Owner Response", Inter Partes Review—Patent Owner Response; U.S. Pat. No. 8,631,935; Inter Partes Review No. IPR2015-00511; Filed Apr. 22, 2015.
"Inter Partes Review—Patent Owner Response", Inter Partes Review—Patent Owner Response; U.S. Pat. No. 8,631,935; Inter Partes Review No. IPR2015-00513; Filed Apr. 21, 2015.
"Inter Partes Review—Patent Owner Response", Inter Partes Review—Patent Owner Response; U.S. Pat. No. 8,678,190; Inter Partes Review No. IPR2015-00514; Filed Apr. 21, 2015.
"IPR2015-00514 Decision Institution of Inter Partes Review", IPR2015-00514; U.S. Pat. No. 8,678,190; Mailed Jun. 26, 2015; Decision Institution of Inter Partes Review.
"IPR2015-00509 Institution Decision", IPR2015-00509; U.S. Pat. No. 8,448,786; Mailed Jul. 15, 2015; Decision Denying Institution of Inter Partes Review.
"IPR 2015-00514 Petitioner's Request for Rehearing", IPR 2015-00514 Petitioner's Request for Rehearing; U.S. Pat. No. 8,678,190; Dated Jul. 10, 2015.
"IPR2015-00511 Institution Decision", IPR2015-00511; U.S. Pat. No. 8,631,935; Entered Jul. 15, 2015; Decision Denying Institution of Inter Partes Review.
"IPR2015-00513 Institution Decision", IPR2015-00513 Institution Decision; U.S. Pat. No. 8,631,935; Entered Jul. 15, 2015; Decision Institution of Inter Partes Review.
Hand, Melanie Jo "Final OA", U.S. Appl. No. 13/860,902, filed Apr. 11, 2013; Mailed May 22, 2015.
"IPR 2015-00514—Request for Rehearing Denied", IPR2015-00514; U.S. Pat. No. 8,678,190; Decision on Request for Rehearing—Denied; Mailed Jul. 16, 2015.
"IPR 2015-00514—Patent Owner's Objection to Evidence", IPR 2015-00514—Patent Owner's Objection to Evidence Submitted During a Preliminary Proceeding; U.S. Pat. No. 8,678,190; Mailed Jul. 13, 2015.
"IPR2015-00513—Patent Owner's Request for Adverse Judgement", U.S. Pat. No. 8,631,935; Mailed Jul. 23, 2015.
"IPR0215-00513 Scheduling Order", U.S. Pat. No. 8,631,935; Mailed Jul. 15, 2015.
"IPR 2015-00514—Patent Owner's Request for Adverse Judgement", U.S. Pat. No. 8,678,190; Mailed Jul. 23, 2015.
"IPR2015-00514—Scheduling Order", U.S. Pat. No. 8,678,190; Mailed Jun. 26, 2015.
"IPR2015-00514 Judgement—Termination of Proceeding", U.S. Pat. No. 8,678,190; Mailed Jul. 24, 2015.
Hand, Melanie J., "Notice of Allowance", U.S. Appl. No. 13/860,902, filed Apr. 11, 2013; Mailed Aug. 4, 2015.
"IPR2015-00513—Request for Adverse Judgement", IPR2015-00513—Request for Adverse Judgement; Granted—Proceedings Terminated; U.S. Pat. No. 8,631,935; Entered Aug. 11, 2015.
"Australian First Exam Report", AU Patent Application No. 2011351971; Patent Examination Report No. 1; Mailed Jul. 25, 2015.
Poon, Robert "Final OA", U.S. Appl. No. 14/265,920, filed Apr. 30, 2014; Mailed Oct. 2, 2015.
Poon, Robert "Final OA", U.S. Appl. No. 14/265,909, filed Apr. 30, 2015; Mailed Oct. 5, 2015.
*Medline Industries, Inc.* vs *C.R. Bard, Inc*; No. 1:14-cv-03618; Notice of Medline Industries Inc's Motion to Dismiss C.R. Bard Inc's Inequitable Conduct Counterclaim and to strike affirmative defense for the '786 Patent; Filed Oct. 20, 2015.
*Medline Industries, Inc.* vs *C.R. Bard, Inc*; No. 1:14-cv-03618; Medline Industries Inc's Opposition to C.R.Bard Inc's Motion for Leave to File Second Amended Answer to Add Counterclaim; Filed Oct. 20, 2015.
Chinese Application No. 201280035240.4; Filed May 24, 2012; Mailed Aug. 18, 2015.
Hand, Melanie J., "NonFinal OA", U.S Appl. No. 14/165,044, filed Jan. 27, 2014; Mailed Oct. 26, 2015.
Poon, Robert "NonFinal OA", U.S. Appl. No. 14/718,792, filed May 21, 2015; Mailed Nov. 19, 2015.
*Medline Industries* vs. *CR Bard, Inc*; No. 14-cv-3618; C.R. Bard's LPR 3.1 Contentions; Filed Nov. 24, 2015.
"Office Action Received", Chinese App No. 201280035246.1; NonFinal OA; Mailed Sep. 16, 2015.
Poon, Robert "Final Office Action", U.S. Appl. No. 14/718,912, filed May 21, 2015; Mailed Jan. 5, 2016.
"Office Action", Chinese Application No. 201180066491.4; Mailed Nov. 11, 2015.
Poon, Robert "Notice of Allowance", U.S. Appl. No. 14/718,792, filed May 21, 2015; Mailed Feb. 2, 2016.

(56) References Cited

OTHER PUBLICATIONS

"Office Action", Australian Application No. 2011351971; Mailed Feb. 18, 2016.
EP Application No. 10251025.2-1501; Mailed Feb. 18, 2016.
Mackenzie, Kristian "Office Action", Canadian Application No. 2,705,670; Mailed Apr. 25, 2016.
Mackenzie, Kristian "Office Action", Canadian Application No. 2,705,647; Mailed Apr. 21, 2016.
*Medline Industries, Inc.* vs *C.R. Bard, Inc*; No. 14-cv-3618; Memorandum in Support of C.R. Bard's Motion for Leave to File Second Amended Answer to Add Counterclaim; Filed Sep. 25, 2015.
*Medline Industries, Inc.* vs *C.R. Bard, Inc*; No. 1:14-cv-03618; Defendant C.R. Bards, Inc's Second Amended Answer to Second Amended Complaint; Filed Sep. 25, 2015.
"DVD", *Entitled "Preventing UTI: Care and Catheterization Techniques"*; Publication Date unknown but believed to be prior to 2007.
Poon, Robert "NonFinal OA", U.S. Appl. No. 15/067,903; filed Mar. 11, 2016; dated Jun. 30, 2016.
"Second Office Action", Chinese Application No. 201280035240.4; dated Jun. 23, 2016.
"Intent to Grant", Chinese Application No. 201180066491.4; filed Dec. 30, 2011; dated Jul. 6, 2016.
"Notice of Acceptance", Australian Application No. 2011351971; filed Dec. 30, 2011; dated May 13, 2016.
"Office Action", Chinese Application No. 201280035246.1; filed May 11, 2012; dated Jul. 15, 2016.
Marcetich, Adam M., "Final OA", U.S. Appl. No. 14/165,044; filed Jan. 27, 2014; dated Aug. 11, 2016.
*Medline Industries Inc.* vs *C.R. Bard, Inc*; C.R. Bard's LPR 3.1 Contentions; Civil Action No. 1:16-cs-3529; Judge Sharon Johnson Coleman; Filed Aug. 26, 2016.
"Medline Catalog", *Turkel Safety Thoracentesis Procedure Trays by Covidien;* http://www.medline.com/jump/sku/x/MDPKDL566059; Unknown Publication date but believed to be prior to present application filing date.
"Medline Catalog", *Turkel Safety Thoracentesis Procedure Trays by Covidien; 5;* http://www.medline.com/sku/item/MDPKDL566075; Unknown Publication date but believed to be prior to present application filing date.
"Medline Catalog", *Paracentesis Trays by Covidien;* http://www.medline/com/sku/item/MDPSWD568006; Unknown Publication Date but believed to be prior to filing of present application.
"Medline Catalog", *Argyle Turkel Safety Thoracentesis System by Covidien;* http://www.medline.com/sku/item/MDPKDL5014; Unknown Publication Date but to believe to be prior to filing of present application.
"Medline Catalog", *Argyle Trocar Catheter Kits by Covidien;* http://www.medline.com/sku/item/MDPKDL5014; Unknown Publication Date but believed to be prior to filing of present application.
"Medline Catalog", *Paracentesis Trays by Halyard Health;* http://www.medline.com/sku/item/MDPSWD565028; Unknown Publication Date but believed to be prior to filing of present application.
"Medline Catalog", *Safe-T Thoracentesis/Paracentesis Tray by Carefusion;* http://www.medline.com/sku/item/MDPBXTTPT1000SP; Unknown publication date but believed to be prior to filing of present application.
"Medline Catalog", *Thoracentesis Trays by Carefusion;* http://www.medline.com/sku/item/MDPBXTTPT1000SP; Unknown publication date but believed to be prior to filing of present application.
"Medline Catalog", *Argyle Turkel Safety Thoracentesis System by Covidien; 6;* http://www.medline.com/sku/item/MDPKDL5016; Unknown Publication Date but believed to be prior to filing of present application.
Marcetich, Adam "Notice of Allowance", U.S. Appl. No. 13/860,902, filed Apr. 11, 2013; dated Sep. 14, 2016.
Poon, Robert "NonFinal OA", U.S. Appl. No. 14/265,909; filed Apr. 30, 2014; dated Sep. 12, 2016.
Cavanna, Mark "Non-Final Office Action", U.S. Appl. No. 29/479,600, filed Jan. 17, 2014; dated Sep. 26, 2016.
Poon, Robert "Appeal Decision", U.S. Appl. No. 13/374,509, filed Dec. 30, 2011; Mailed Oct. 24, 2016.
Long, Fonya M "Appeal Decision", U.S. Appl. No. 13/154,265, filed Jun. 3, 2011; Mailed Oct. 6, 2016.
Poon, Robert "Appeal Decision", U.S. Appl. No. 13/153,300, filed Jun. 3, 2011; Mailed Oct. 12, 2016.
Marcetich, Adam "Notice of Allowance", U.S. Appl. No. 13/860,902, filed Apr. 11, 2013; dated Nov. 8, 2016.
Schultz, Ottmar "Extended European Search Report", EP Application No. 16177903.8-1501; Filed Jun. 30, 2009; dated Oct. 27, 2016.
Hand, Melanie J., "NonFinal OA", U.S. Appl. No. 13/860,902, filed Apr. 11, 2013; dated Apr. 1, 2016.
"Office Action", Chinese Application No. 201280035246.1; filed May 11, 2012; dated Nov. 28, 2016.
"Third Office Action", Chinese Application No. 201280035240.4; dated Apr. 1, 2017.
Cavanna, Mark , "Final OA", U.S. Appl. No. 29/479,600, filed Jan. 17, 2014; dated Jun. 1, 2017.
Gilligan, C. Luke, "Notice of Allowance", U.S. Appl. No. 13/153,265, filed Jun. 3, 2011; dated Jun. 15, 2017.
MacKenzie, Kristian, "Office Action", Canadian Application No. 2,705,647; dated Feb. 10, 2017.
MacKenzie, Kristian , "Office Action", Canadian Application No. 2,705,670; dated Feb. 10, 2017.
Marcetich, Adam, "Notice of Allowance", U.S. Appl. No. 14/165,044, filed Jan. 27, 2014; dated Feb. 28, 2017.
Marcetich, Adam , "Notice of Allowance", U.S. Appl. No. 14/793,455, filed Jul. 7, 2015; dated Jul. 20, 2017.
Marcitech, Adam , "NonFinal OA", U.S. Appl. No. 14/793,455, filed Jul. 7, 2015; dated May 3, 2017.
Poon, Robert , "Final OA", U.S. Appl. No. 14/265,909, filed Apr. 30, 2014; dated Jan. 10, 2017.
Poon, Robert , "Final OA", U.S. Appl. No. 15/067,903, filed Mar. 11, 2016; dated Jan. 13, 2017.
Poon, Robert , "Non-Final OA", U.S. Appl. No. 14/265,909, filed Apr. 30, 2014; dated Aug. 24, 2017.
Poon, Robert, "Notice of Allowance", U.S. Appl. No. 14/265,909, filed Apr. 30, 2014; dated Oct. 2, 2017.
Poon, Robert, "Notice of allowance", U.S. Appl. No. 15/067,903, filed Mar. 11, 2016; dated Aug. 23, 2017.
Pothier, Andrew, "Office Action", Canadian Application No. 2,822,905; dated May 1, 2017.
"Intent to Grant", European Application No. 16177903.8-1501; dated Sep. 18, 2017.
"Notice of Allowance", Canadian Application No. 2,705,647; Filed May 27, 2010; dated Oct. 12, 2017.
"Notice of Allowance", Chinese Application No. 201280035240.4; dated Nov. 7, 2017.
"Notice of Allowance", Candaian Application No. 2,705,670; dated Nov. 3, 2017.
Pothier, Andrew, "Non-Final Office Action", Canadian Application No. 2,822,905; dated Dec. 18, 2017.
Tomes, Jennifer, "NonFinal OA", U.S. Appl. No. 29/479,600, filed Jan. 17, 2014; dated Jan. 3, 2018.
Poon, Robert, "NonFinal Office Action", U.S. Appl. No. 15/703,514, filed Sep. 13, 2017; dated Jun. 22, 2018.
Poon, Robert, "NonFinal Office Action", U.S. Appl. No. 15/804,520, filed Nov. 6, 2017; dated Jun. 6, 2018.
*Medline Industries Inc* vs *C.R Bard. Inc.*, Exhibit G to Declaration of Dylan J. Raife in Support of Bard Opening Claim Construction Brief; Civil Action No. 1:16-cv-03529; Judge Sharon Johnson Coleman; Filed Nov. 11, 2016.
*Medline Industries Inc* vs *C.R Bard, Inc.*, Exhibit 1 to Declaration of Karl L. Leinsing in Support of Bard's Rebuttal on Claim Construction; Civil Action No. 1:16-cv-03529; Judge Sharon Johnson Coleman; Filed Jan. 12, 2018.
*Medline Industries Inc* vs *C.R Bard, Inc.* Exhibit a lo Declaration of Bnan Eutermoser in Support of Medline Response to Bard Opening Claim Construction; Civil Action No. 1:16-cv-03529; Judge Sharon Johnson Coleman; Filed Dec. 9, 2016.

(56) References Cited

OTHER PUBLICATIONS

*Medline Industries Inc* vs *C.R Bard, Inc*. Exhibit A to Declaration of Dylan J Raife in Support of Bard's Reply Claim Construction Brief; Civil Action No. t:14-cv-03618: Judge John Z. Lee; Filed Aug. 15, 2016.
*Medline Industries Inc*. vs *C.R Bard, Inc*: Exhibit F to C.R. Bard's LPR 2.3 Contentions; Civil Action No. 1:17-cv-7216; Judge Sara L. Ellis; Filed Jan. 16, 2018.
*Medline Industries Inc*. vs *C.R Bard. Inc*., Exhibit 4 to Declaration ofRichard Meyst re Claim Construction; Civil Action No. 1:16-cv-03529: Judge Sharon Johnson Coleman; Filed Dec. 9, 2016.
*Medline Industries Inc*. vs *C.R Bard. Inc*., Exhibit C to Declaration of Nicole Smith in Support of Bard Reply to Claim Construction Brief; Civil Action No. 1:16-cv-03529; Judge Sharon Johnson Coleman. Filed Jan. 12. 2018.
*Medline Industries Inc*. vs *C.R Bard. Inc*. Exhibit 3 to Declaration of Richard Meyst re Claim Construction; Civil Action No. 1:16-cv-03529: Judge Sharon Johnson Coleman. Filed Dec. 9, 2016.
*Medline Industries Inc*. vs *C.R Bard. Inc*.; Exhibit C to Declaration of Nicole Smith in Support of Bard Reply to Medline Claim Construction Brief; Civil Action No. 116-cv-03529; Judge Sharon Johnson Coleman; Filed Jan. 27, 2017.
*Medline Industries Inc*. vs *C.R Bard. Inc*.; Exhibit F to Declaration of Brian Eutermoser in Support of Medline Response to Bard Opening Claim Construction; Civil Action No. 1:16-cv-03529; Judge Sharon Johnson Coleman: Filed Dec. 9, 2016.
*Medline Industries Inc*. vs *C.R. Bard, Inc*.; Exhibit E to Declaration of Nicole Smith in Support of Bard Reply lo Claim Construction Brief; Civil Action No. 1:16-cv-03529. Judge Sharon Johnson Coleman. Filed Jan. 12, 2018.
*Medline Industries Inc*. vs *C.R. Bard, Inc*., Exhibit A (List of Invalidating Prior Art) to C R. Bard's LPR 2 3 Contentions; Civil Action No. t:17-cv-7216; Judge Sara L. Ellis; Filed Jan. 16, 2018.
*Medline Industries Inc*. vs *C R. Bard, Inc*; Exhibit E to Declaration of Dylan Raife in Support of Motion for Leave to Add Counter-claims; Civil Action No. 1:17-cv-7216; Judge Sara L. Ellis; Filed Feb. 27.2018.
*Medline Industries Inc*., vs *C.R Bard, Inc*.; Exhibit A to Declaration of Nicole M. Smith; Civil Action No. 1:14-cv-03618; Judge John Z. Lee: Filed Jun. 4, 2016.
*Medline Industries Inc*. vs *C R. Bard, Inc*; C.R Bard's LPR 2 3 Contentions; Civil Action No. 1:17-cv-7216, Judge Sara L. Ellis; Filed Jan. 16, 2018.
*Medline Industries Inc*. vs *C R. Bard, Inc*; Declaration of Nicole M Smith in Support of Bard Opening Claim Construction Brief; Civil Action No. 1:14-cv-03618: Judge John Z. Lee; Filed Jun. 4, 2016.
*Medline Industries Inc*. vs *C R. Bard, Inc*; Exhibit B to Declaration of Dylan Raife in Support of Motion for Leave to Add Counter-claims; Civil Action No. 1:17-cv7216; Judge Sara L. Ellis; Filed Feb. 27,2018.
*Medline Industries Inc*. vs *C R. Bard, Inc*; Exhibit D to Declaration of Dylan Raife in Support of Motion for Leave to Add Counter-claims; Civil Action No. 1:17-cv-7216; Judge Sara L. Ellis: Filed Feb. 27.2018.
*Medline Industries Inc*. vs *C.R Bard, Inc*.; Exhibit G to Declaration of Nicole M. Smith; Civil Action No. 1:14-cv-03618; Judge John Z, Lee; Filed Jun. 4, 2016.
*Medline Industries Inc*. vs *C.R Bard, Inc*.; Exhibit H to Declaration of Nicole M. Smith; Civil Action No. 1:14-cv-03618; Judge John Z. Lee; Filed Jun. 4, 2016.
*Medline Industries Inc*. vs*C R. Bard, inc*; Exhibit A-C R. Bards Second Amended Answer to Second Amended Complaint: Civil Action No. 1:!7-cv-7216; Judge Sara L Ellis; Filed Feb. 27,2018.
*Medline Industries Inc*. vs *C.R Bard, Inc*., Declaration of Barbara Weintraub re Claim Construction; Civil Action No. 1:16-cv-03529; Judge Sharon Johnson Coleman; Filed Dec. 22, 2017.
*Medline Industries Inc*. vs *C.R Bard, Inc*., Declaration of Dylan J Raife in Support of Bard Opening Claim Construction Brief; Civil Action No. 1:16-cv-03529; Judge Sharon Johnson Coleman; Filed Nov. 17, 2017.
*Medline Industries Inc*. vs *C.R Bard, Inc*., Declaration of Nicole Smith in Support of Bard Reply to Medline Claim Construction Brief; Civil Action No. 1:16-cv-03529; Judge Sharon Johnson Coleman; Filed Jan. 27, 2017.
*Medline Industries Inc*. vs *C.R Bard, Inc*., Exhibit 1 to Declaration ofRichard Meyst re Claim Construction; Civil Action No. 1:16-cv-03529; Judge Sharon Johnson Coleman; Filed Dec. 9, 2016.
*Medline Industries Inc*. vs *C.R Bard, Inc*., Exhibit 2 lo Declaration ofRichard Meyst re Claim Construction; Civil Action No. 1:16-cv-03529; Judge Sharon Johnson Coleman; Filed Dec. 9, 2016.
*Medline Industries Inc*. vs *C.R Bard, Inc*., Exhibit 7 to Declaration of Richard Meyst Regarding Claim Construction: Civil Action No. 1:14-cv-03618; Judge John Z. Lee; Filed Jul. 8, 2016.
*Medline Industries Inc*. vs *C.R Bard, Inc*., Exhibit A to Declaration of Dylan J Raife in Support of Bard Opening Claim Construction Brief; Civil Action No. 1;16-cv-03529; Judge Sharon Johnson Coleman; Filed Nov. 11, 2016.
*Medline Industries Inc*. vs *C.R Bard, Inc*., Exhibit A to Declaration of Kevin A. Lake. Civil Action No. 1:14-cv-03618; Judge John Z. Lee; Filed Jul. 8, 2016.
*Medline Industries Inc*. vs *C.R Bard, Inc*., Exhibit B to Declaration of Brian Eutermoser in Support of Medline Response to Bard Opening Claim Construction; Civil Action No. 1:16-cv-03529: Judge Sharon Johnson Coleman: Filed Dec. 9, 2016.
*Medline Industries Inc*. vs *C.R Bard, Inc*., Exhibit F to Declaration of Dylan J. Raife in Support of Bard Opening Claim Construction Brief, Civil Action No. 1:16-cv-03529; Judge Sharon Johnson Coleman; Filed Nov. 11, 2016.
*Medline Industries Inc*. vs *C.R Bard, Inc*., Exhibit F to Declaration of Nicole Smith in Support of Bard Reply to Medline Claim Construction Brief; Civil Action No. 1:16-cv-03529; Judge Sharon Johnson Coleman; Filed Jan. 27, 2017.
*Medline Industries Inc*. vs *C.R Bard, Inc*., Exhibit H to Declaration of Kevin A. Lake; Civil Action No. 1:14-cv-03618: Judge John Z. Lee; Filed Jul. 8, 2016.
*Medline Industries Inc*. vs *C.R Bard, Inc*. Bard Opening Claim Construction Brief; Civil Action No. 1:16-cv-03529; Judge Sharon Johnson Coleman; Filed Nov. 11, 2016.
*Medline Industries Inc*. vs *C.R Bard, Inc*. Declaration of Dylan J Raife in Support of Bard's Reply Claim Construction Brief: Civil Action No. 1:14-cv-03518; Judge John Z. Lee; Filed Aug. 15, 2016.
*Medline Industries Inc*. vs *C.R Bard, Inc*. Exhibit 1 to Declaration of Dylan J. Raife in Support of Bard Opening Claim Construction Brief; Civil Action No. 1:16-cv-03529; Judge Sharon Johnson Coleman; Filed Nov. 11, 2016.
*Medline Industries Inc* vs *C.R Bard, Inc*. Exhibit 10 to Declaration of Richard Meyst Regarding Claim Construction: Civil Action No. 1:14-cv-03618; Judge John Z. Lee; Filed Jul. 8, 2016.
*Medline Industries Inc*. vs *C.R Bard, Inc*. Exhibit 2 to Declaration of Brian Eutermoser in Support of Medline Surrepiy: Civil Action No. 1:14-cv-03618; Judge John Z. Lee; Filed Sep. 7, 2016.
*Medline Industries Inc*. vs *C.R Bard, Inc*. Exhibit C to Declaration of Dylan J Raife in Support of Bard Opening Claim Construction Brief; Civil Action No. 1:16-cv-03529; Judge Sharon Johnson Coleman: Filed Nov. 11, 2016.
*Medline Industries Inc*. vs *C.R Bard, Inc*. Exhibit E to Declaration of Nicole Smith in Support of Bard Reply to Medline Claim Construction Brief; Civil Action No. 1:16-cv-03529; Judge Sharon Johnson Coleman; Filed Jan. 27, 2017.
*Medline Industries Inc*. vs *C.R Bard, Inc*. Exhibit I to Declaration of Brian Eutermoser in Support of Medline Response to Bard Opening Claim Construction; Civil Action No. 1:16-cv-03529; Judge Sharon Johnson Coleman; Filed Dec. 9, 2016.
*Medline Industries Inc*. vs *C.R Bard, Inc*. Exhibit i to Declaration of Nicole M. Smith, Civil Action No. 1:14-cv-03618: Judge John Z. Lee; Filed Jun. 4, 2016.
*Medline Industries Inc*. vs *C.R Bard, Inc*.; Bard Reply to Medline Claim Construction Brief; Civil Action No. 1 I6-cv-03529; Judge Sharon Johnson Coleman; Filed Jan. 27, 2017.
*Medline Industries Inc*. vs *C.R Bard, Inc*.; C. R. Bard's Reply in Support of Claim Construction Brief; Civil Action No. 1:14-cv-03618, Judge John Z. Lee; Filed Aug. 15, 2016.

(56) References Cited

OTHER PUBLICATIONS

*Medline Industries Inc.* vs *C.R Bard, Inc.*; Declaration of Karl L Leinsing in Support of Bard's Rebuttal on Claim Construction; Civil Action No. 1:16-CV-03529; Judge Sharon Johnson Coleman; Filed Jan. 12, 2018.
*Medline Industries Inc.* vs *C.R Bard, Inc.*; Declaration of Karl L. Leinsing in Support of Bard's Rebuttal on Claim Construction; Civil Action No. 1:14-cv-03618. Judge John Z. Lee; Filed Aug. 15, 2016.
*Medline Industries Inc.* vs *C.R Bard, Inc.*; Declaration of Richard Meyst re Claim Construction; Civil Action No. 1:16-cv-03529. Judge Sharon Johnson Coleman; Filed Dec. 9, 2016.
*Medline Industries Inc.* vs *C.R Bard, Inc.*; Exhibit 1 to Declaration of Karl L Leinsing in Support of Bard's Rebuttal on Claim Construction; Civil Action No. 1:14-cv-03618; Judge John Z. Lee, Filed Aug. 15, 2016.
*Medline Industries Inc.* vs *C.R Bard, Inc.*; Exhibit 1 to Declaration of Karl R Leinsing in Support of Bard Reply to Medline Claim Construction Brief; Civil Action No. 1:16-cv-03529; Judge Sharon Johnson Coleman; Filed Jan. 27, 2017.
*Medline Industries Inc.* vs *C.R Bard, Inc.*; Exhibit 3 to Declaration of Richard Meyst Regarding Claim Construction; Civil Action No. 1:14-cv-03618; Judge John Z. Lee, Filed Jul. 8, 2016.
*Medline Industries Inc.* vs *C.R Bard, Inc.*; Exhibit 4 to Declaration of Richard Meyst Regarding Claim Construction; Civil Action No. 1:14-cv-03618; Judge John Z. Lee. Filed Jul. 8, 2016.
*Medline Industries Inc.* vs *C.R Bard, Inc.*; Exhibit A to Declaration of Barbara Weintraub re Claim Construction; Civil Action No. 1:16-cv-03529; Judge Sharon Johnson Coleman. Filed Dec. 9, 2016.
*Medline Industries Inc.* vs *C.R Bard, Inc.*; Exhibit B to Declaration of Nicole Smith in Support of Bard Reply to Claim Construction Brief; Civil Action No. 1;16-cv-03529. Judge Sharon Johnson Coleman. Filed Jan. 12, 2018.
*Medline Industries Inc.* vs *C.R Bard, Inc.*; Exhibit B to Declaration of Dylan J Raife in Support of Bard's Reply Claim Construction Brief; Civil Action No. 1:14-cv-03618; Judge John Z. Lee; Filed Aug. 15, 2016.
*Medline Industries Inc.* vs *C.R Bard, Inc.*; Exhibit C to Declaration of Dylan J Raife in Support of Bard's Reply Claim Construction Brief; Civil Action No. 1:14-cv 03618; Judge John Z. Lee; Filed Aug. 15, 2016.
*Medline Industries Inc.* vs *C.R Bard, Inc.*; Exhibit D to Declaration of Brian Eutermoser in Support of Medline Response to Bard Opening Claim Construction; Civil Action No. 1:16-cv-03529; Judge Sharon Johnson Coleman; Filed Dec. 9, 2016.
*Medline Industries Inc.* vs *C.R Bard, Inc.*; Exhibit D to Declaration of Dylan J Raife in Support of Bard's Reply Claim Construction Brief: Civil Action No. 1:14-cv-03618; Judge John Z. Lee. Filed Aug. 15, 2016.
*Medline Industries Inc.* vs *C.R Bard, Inc.*; Exhibit D to Declaration of Nicole Smith in Support of Bard Reply to Medline Claim Construction Brief; Civil Action No. 1:16-cv-03529; Judge Sharon Johnson Coleman; Filed Jan. 27, 2017.
*Medline Industries Inc.* vs *C.R Bard, Inc.*; Exhibit E to Declaration of Kevin A. Lake; Civil Action No. 1:14-cv-03618, Judge John Z. Lee; Filed Jul. 8, 2016.
*Medline Industries Inc.* vs *C.R Bard, Inc.*; Exhibit F lo Declaration of Kevin A Lake: Civil Action No. 1:14-cv-03618. Judge John Z. Lee; Filed Jul. 8, 2016.
*Medline Industries Inc.* vs *C.R Bard, Inc.*; Exhibit F to Declaration of Dylan J. Raife in Support of Bard's Reply Claim Construction Brief; Civil Action No. 1. I4-cv-03618; Judge John Z. Lee, Filed Aug. 15, 2016.
*Medline Industries inc* vs *C.R Bard, Inc.*; Exhibit G to Declaration of Kevin A. Lake; Civil Action No. 1:14-cv-03618. Judge John Z. Lee; Filed Jul. 8, 2016.
*Medline Industries Inc* vs *C.R Bard, Inc.*; Exhibit G to Declaration of Nicole Smith in Support ofBard Reply to Medline Claim Construction Brief: Civil Action No. 1:16-cv-03529: Judge Sharon Johnson Coleman; Filed Jan. 27, 2017.
*Medline Industries Inc* vs *C.R Bard, Inc.*; Exhibit H to Declaration of Brian Eutermoser in Support of Medline Response to Bard Opening Claim Construction; Civil Action No. 1:16-cv-03529; Judge Sharon Johnson Coleman; Filed Dec. 9, 2016.
*Medline Industries Inc* vs *C.R Bard, Inc.*; Exhibit H to Declaration of Dylan J. Raife in Support of Bard Opening Claim Construction Brief. Civil Action Mo. 1:16-cv-Q3529; Judge Sharon Johnson Coleman; Filed Nov. 11, 2016.
*Medline Industries Inc* vs *C.R Bard, Inc.*; Exhibit I to Declaration of Kevin A. Lake; Civil Action No. 1:14-sv-03618; Judge John Z. Lee; Filed Jul. 8, 2016.
*Medline Industries Inc* vs *C.R Bard, Inc.*; Exhibit N To Declaration of Brian Eutermoser in Support of Medline Response to Bard Opening Claim Construction; Civil Action No. 1:16-cv-03529; Judge Sharon Johnson Coleman; Filed Dec. 9, 2016.
*Medline Industries Inc.* vs *C.R Bard, Inc.*; Medline Memo of Law re Expert Testimony in Claim Construction Proceedings; Civil Action No. 1;14-cv-03618; Judge John Z. Lee. Filed Jan. 25,2017.
*Medline Industries Inc.* vs *C.R Bard, Inc.*; Medline Surreply to Claim Construction Brief; Civil Action No. 1:14-CV-Q3618: Judge John Z. Lee; Filed Sep. 7, 2016.
*Medline Industries Inc.* vs *C.R Bard, Inc.*; Transcript of Deposition of Richard Meyst; Civil Action No. 1:16-W-03529. Jan. 20, 2017.
*Medline Industries Inc.* vs *C.R Bard, Inc*: Exhibit G to C.R Bard's LPR 2.3 Contentions; Civil Action No. 1:17-cv-7216; Judge Sara L Ellis; Filed Jan. 16, 2018.
*Medline Industries Inc.* vs *C.R Bard, Inc*; Exhibit 3 to C.R. Bard's LPR 2.3 Contentions; Civil Action No. 1:17-CV-7216; Judge Sara L Ellis; Filed Jan. 16, 2018.
*Medline Industries Inc.* vs *C.R Bard, Inc*; Exhibit C to C.R. Bard's LPR 2.3 Contentions; Civil Action No. 1:17-cv-7216; Judge Sara L. Ellis; Filed Jan. 16, 2018.
*Medline Industries Inc.* vs *C.R Bard, Inc*; Exhibit D to C.R. Bard's LPR 2.3 Contentions; Civil Action No. 1:17-cv-7216; Judge Sara L. Ellis; Filed Jan. 16, 2018.
*Medline Industries Inc.* vs *C.R Bard, Inc*; Exhibit E to C R. Bard's LPR 2.3 Contentions; Civil Action No. 1;17-cv-7216; Judge Sara L. Ellis; Filed Jan. 16, 2018.
*Medline Industries Inc.* vs *C.R Bard. Inc*, Exhibit H loC.R. Bard's LPR 2.3 Contentions. Civil Action No. 1:17-CV-7216; Judge Sara L. Ellis: Filed Jan. 16, 2018.
*Medline Industries Inc.* vs *C.R Bard. Inc.*, Declaration of Bnan Eutermoser in Support of Medline Surreply. Civil Action No. 1:14-cv-03618, Judge John Z. Lee; Filed Sep. 7, 2016.
*Medline Industries Inc.* vs *C.R Bard. Inc.*, Exhibit 8 lo Declaration of Richard Meyst Regarding Claim Construction: Civil Action No. 1:14-cv-03618: Judge John Z. Lee: Filed Jul. 8, 2016.
*Medline Industries Inc.* vs *C.R Bard. Inc.*, Exhibit A to Declaration of Barbara Weintraub Regarding Claim Construction: Civil Action No. 1:14-cv-03618. Judge John Z. Lee; Filed Jul. 8, 2016.
*Medline Industries Inc.* vs *C.R Bard. Inc.*, Exhibit A to Declaration of Nicole Smith in Support of Bard Repiy lo Medline Claim Construction Brief; Civil Action No. 1:16-cv-03529; Judge Sharon Johnson Coleman; Filed Jan. 27, 2017.
*Medline Industries Inc.* vs *C.R Bard. Inc.*, Exhibit B to Declaration of Dylan J Raife in Support of Bard Opening Claim Construction Brief; Civil Action No. 1:16-cv-03529; Judge Sharon Johnson Coleman; Filed Nov. 11, 2016.
*Medline Industries Inc.* vs *C.R Bard. Inc.*, Exhibit E to Declaration of Dylan J Raife in Support of Bard's Reply Claim Construction Brief; Civil Action No. 1:14-cv-03618; Judge John Z. Lee, Filed Aug. 15, 2016.
*Medline Industries Inc.* vs *C.R Bard. Inc.* Declaration of Richard Meyst Regarding Claim Construction; Civil Action No. 1:14-cv-03618; Judge John Z. Lee; Filed Jul. 8, 2016.
*Medline Industries Inc.* vs *C.R Bard. Inc.* Exhibit 11 to Declaration of Richard Meyst re Claim Construction: Civil Action No. 1:16-cv-03529; Judge Sharon Johnson Coleman; Filed Dec. 9, 2016.
*Medline Industries Inc.* vs *C.R Bard. Inc.* Exhibit A to Declaration of Richard Meyst Regarding Claim Construction; Civil Action No. 1;14-cv-03618; Judge John Z. Lee; Filed Jul. 8, 2016.

(56) References Cited

OTHER PUBLICATIONS

*Medline Industries Inc.* vs *C.R Bard. Inc.* Medline Motion lo Supplement Record on Claim Construction with Leinsing Testimony; Civil Action No. 1:14-w-03618; Judge John Z. Lee; Filed Mar. 23, 2017.
*Medline Industries Inc.* vs *C.R Bard. Inc.*; Bard Reply Claim Construction Brief; Civil Action No. 1:16-cv-03529; Judge Sharon Johnson Coleman; Filed Jan. 12, 2018.
*Medline Industries Inc.* vs *C.R Bard. Inc.*; Bard Response to Memo of Law re Expert Testimony in Claim Construction Proceedings; Civil Action No. 1:14-cv-03618; Judge John Z. Lee. Filed Feb. 8, 2017.
*Medline Industries Inc.* vs *C.R Bard. Inc.*; Declaration of Brian Eutermoser in Support of Medline Response to Bard Opening Claim Construction Brief. Civil Action No. 1:16-cv-03529; Judge Sharon Johnson Coleman; Filed Dec. 22, 2017.
*Medline Industries Inc.* vs *C.R Bard. Inc.*; Declaration of Karl R. leinsing in Support of Bard Reply io Medline Claim Construction Brief; Civil Action No. 1:16-cv-03529; Judge Sharon Johnson Coleman; Filed Jan. 27, 2017.
*Medline Industries Inc.* vs *C.R Bard. Inc.*; Exhibit 3 to Declaration ofPeter Sauer in Support of Medline's Motion to Supplement Record; Civil Action No. 1:14-cv-03618: Judge John Z. Lee. Filed Mar. 23, 2017.
*Medline Industries Inc.* vs *C.R Bard. Inc.*; Exhibit 8 to Declaration of Richard Meyst re Claim Construction; Civil Action No. 1:16-cv-03529; Judge Sharon Johnson Coleman; Filed Dec. 9, 2016.
*Medline Industries Inc.* vs *C.R Bard. Inc.*; Exhibit C to Declaration of Kevin A. Lake; Civil Action No. 1 14-cv-03618. Judge John Z. Lee; Filed Jul. 8, 2016.
*Medline Industries Inc.* vs *C.R Bard. Inc.*; Exhibit G to Declaration of Dylan J. Raife in Support of Bard Opening Claim Construction Brief, Civil Action No. 1:16-cv-03529; Judge Sharon Johnson Coleman; Filed Nov. 17,2017.
*Medline Industries Inc.* vs *C.R Bard. Inc.*; Exhibit G to Declaration ofBrian Eutermoser in Support of Medline Response to Bard Opening Claim Construction; Civil Action No. 1:16-cv-03529; Judge Sharon Johnson Coleman; Filed Dec. 9, 2016.
*Medline Industries Inc.* vs *C.R Bard. Inc.*; Exhibit H to Declaration of Dylan J Raife in Support of Bard Opening Claim Construction Brief, Civil Action No. 1:16-cv-03529; Judge Sharon Johnson Coleman; Filed Nov. 17,2017.
*Medline Industries Inc.* vs *C.R Bard. Inc.*; Medline Response to Bard Opening Claim Construction; Civil Action No. 1:16-cv-03529; Judge Sharon Johnson Coleman; Filed Decembers, 2016.
*Medline Industries Inc.* vs *C.R Bard. Inc.*; Transcript of Deposition of Barbara A Weintraub; Civil Action Mo. 1:16-cv-03529; Jan. 20.2017.
*Medline Industries Inc.* vs *C.R Bard. Inc.*; Transcript ofDeposition of Karl Leinsing; Civil Action No. 1:16-cv-03529; Feb. 17,2017.
*Medline Industries Inc.* vs *C.R Bard, Inc.*; Exhibit 9 to Declaration of Richard Meyst re Claim Construction; Civil Action No. 1:16-cv-03529; Judge Sharon Johnson Coleman; Filed Dec. 9, 2016.
*Medline Industries Inc.* vs *C.R. Bard, Inc.*, Bard Response to Medline Surreply re Claim Construction; Civil Action No. 1:14-cv-03618; Judge John Z. Lee; Filed Sep. 13, 2016.
*Medline Industries Inc.* vs *C.R. Bard, Inc.*, Exhibit 2 to Declaration of Karl L. Leinsing in Support of Bard's Rebuttal on Claim Construction: Civil Action No. 1:14-cv-03618; Judge John Z. Lee; Filed Aug. 15, 2016.
*Medline Industries Inc.* vs *C.R. Bard, Inc.*, Exhibit B to Declaration of Kevin A. Lake. Civil Action No. 1:14-cv-03618; Judge John Z. Lee; Filed Jul. 8, 2016.
*Medline Industries Inc.* vs *C.R. Bard, Inc.*, Exhibit D to Declaration of Nicole Smith in Support of Bard Reply to Claim Construction Brief; Civil Action No. 116-cv-03529; Judge Sharon Johnson Coleman. Filed Jan. 12, 2018.
*Medline Industries Inc.* vs *C.R. Bard, Inc.*, Exhibit J to Declaration of Brian Eutermoser in Support of Medline Response to Bard Opening Claim Construction; Civii Action No. 1:16-cv-03529: Judge Sharon Johnson Coleman; Filed Dec. 9, 2016.
*Medline Industries Inc.* vs *C.R. Bard, Inc.*, Exhibit K to Declaration of Bnan Eutermoser in Support of Medline Response to Bard Opening Claim Construction; Civii Action No. 1:16-cv-03529: Judge Sharon Johnson Coleman; Filed Dec. 9, 2016.
*Medline Industries Inc.* vs *C.R. Bard, Inc.* Exhibit 1 to Declaration of Peter Sauer in Support of Medline's Motion to Supplement Record; Civil Action No. 1:14-cv-03618; Judge John Z. Lee; Filed Mar. 23, 2017.
*Medline Industries Inc.* vs *C.R. Bard, Inc.* Exhibit 9 to Declaration of Richard Meyst Regarding Claim Construction; Civil Action No. 1:14-cv-03618; Judge John Z. Lee; Filed Jul. 8, 2016.
*Medline Industries Inc.* vs *C.R. Bard, Inc.* Exhibit L to Declaration of Brian Eutermoser in Support of Medline Response to Bard Opening Claim Construction; Civil Action No. 1:16-cv-03529: Judge Sharon Johnson Coleman: Filed Dec. 9, 2016.
*Medline Industries Inc.* vs *C.R. Bard, Inc.* Medline Response to Bard Claim Construction Brief. Civil Action No. 1:14-cv-03618: Judge John Z. Lee; Filed Jul. 8, 2016.
*Medline Industries Inc.* vs *C.R. Bard, Inc.*: Exhibit 2 to C.R. Bard's LPR 2.3 Contentions; Civil Action No. 117-CV-7216; Judge Sara L Eiiis; Filed Jan. 16, 2018.
*Medline Industries Inc.* vs *C.R. Bard, Inc.*; Declaration of Barbara Weintraub re Claim Construction: Civil Action No. 1:16-cv-03529. Judge Sharon Johnson Coleman; Filed Dec. 9, 2016.
*Medline Industries Inc.* vs *C.R. Bard, Inc.*; Declaration of Brian Eutermoser in Support of Medline Response to Bard Opening Claim Construction; Civil Action No. 1:16-cv-03529; Judge Sharon Johnson Coleman; Filed Dec. 9, 2016.
*Medline Industries Inc.* vs *C.R. Bard, Inc.*; Declaration of Nicole Smith in Support of Bard Reply to Claim Construction Brief; Civil Action No. 1:16-cv-03529; Judge Sharon Johnson Coleman; Filed Jan. 12, 2018.
*Medline Industries Inc.* vs *C.R. Bard, Inc.*; Exhibit 10 lo Declaration of Richard Meyst re Claim Construction; Civil Action No. 1:16-cv-03529; Judge Sharon Johnson Coleman; Filed Dec. 9, 2016.
*Medline Industries Inc.* vs *C.R. Bard, Inc.*; Exhibit 2 to Declaration of Peter Sauer in Support of Medline's Motion to Supplement Record; Civil Action No. 1:14-cv-03618; Judge John Z. Lee. Filed Mar. 23, 2017.
*Medline Industries Inc.* vs *C.R. Bard, Inc.*; Exhibit 5 to Declaration of Richard Meyst re Claim Construction: Civil Action No. 1:16-cv-03529; Judge Sharon Johnson Coleman, Filed Dec. 9, 2016.
*Medline Industries Inc.* vs *C.R. Bard, Inc.*; Exhibit 6 to Declaration of Richard Meyst re Claim Construction; Civil Action No. 1:16-cv-03529; Judge Sharon Johnson Coleman. Filed Dec. 9, 2016.
*Medline Industries Inc.* vs *C.R. Bard, Inc.*; Exhibit 7 to Declaration of Richard Meyst re Claim Construction; Civil Action No. 1:16-cv-03529; Judge Sharon Johnson Coleman; Filed Dec. 9, 2016.
*Medline Industries Inc.* vs *C.R. Bard, Inc.*; Exhibit C to Declaration of Bnan Eutermoser in Support of Medline Response to Bard Opening Claim Construction; Civil Action No. 1:16-cv-03529; Judge Sharon Johnson Coleman; Filed Dec. 9, 2016.
*Medline Industries Inc.* vs *C.R. Bard, Inc.*; Exhibit E to Declaration of Brian Eutermoser in Support of Medline Response to Bard Opening Claim Construction; Civil Action No. 1:16-cv-03529; Judge Sharon Johnson Coleman; Filed Dec. 9, 2016.
*Medline Industries Inc.* vs *C.R. Bard, Inc.*; Exhibit M to Declaration of Brian Eutermoser in Support of Medline Response to Bard Opening Claim Construction; Civil Action No. 1:16-cv-03529; Judge Sharon Johnson Coleman; Filed Dec. 9, 2016.
*Medline Industries Inc.* vs *C.R. Bard. Inc.*, Exhibit 2 to Declaration of Richard Meyst Regarding Claim Construction: Civil Action No. 1:14-cv-03618; Judge John Z. Lee. Filed Jul. 8, 2016.
*Medline Industries Inc.* vs *C.R. Bard. Inc.*; Exhibit 5 to Declaration of Richard Meyst Regarding Claim Construction; Civil Action No. 1:14-cv-03618; Judge John Z. Lee. Filed Jul. 8, 2016.
*Medline Industries Inc.*vs *C.R. Bard. Inc.*; Exhibit 6 to Declaration of Richard Meyst Regarding Claim Construction; Civil Action No. 1:14-cv-03618; Judge John Z. Lee. Filed Jul. 8, 2016.

(56) References Cited

OTHER PUBLICATIONS

*Medline Industries Inc.* vs *C.R. Bard. Inc.*; Medline Response to Bard Opening Claim Construction Brief; Civil Action No. t:16-cv-03529; Judge Sharon Johnson Coleman; Filed Dec. 22, 2017.
*Medline Industries Inc.* vs *OR. Bard, Inc.*; Exhibit E to Declaration of Dylan J Raife in Support of Bard Opening Claim Construction Brief; Civil Action No. 1:16-cv-03529; Judge Sharon Johnson Coleman; Filed Nov. 11, 2016.
*Medline Industries Inc.* vs*C.R Bard, Inc.*, to C.R. Bard's LPR 2.3 Contentions. Civil Action No. 1:17-cv-7216; Judge Sara L. Ellis; Filed Jan. 16, 2018.
*Medline Industries Inc.* vs *C.R Bard, Inc.*, Declaration of Dylan J Raife in Support of Bard Opening Claim Construction Brief; Civil Action No. 1:16-cv-03529; Judge Sharon Johnson Coleman; Filed Nov. 11, 2016.
*Medline Industries Inc.* vs*C.R Bard, Inc.*, Exhibit 11 to Declaration of Richard Meyst Regarding Claim Construction; Civil Action No. 1:14-cv-03618; Judge John Z Lee; Filed Jul. 8, 2016.
*Medline Industries Inc.* vs *C.R Bard, Inc.* Declaration of Kevin A. Lake in Support of Medline Response to Bard Claim Construction Brief: Civil Action No. 1:14-cv-03618; Judge John Z. Lee; Filed Jul. 8, 2016.
*Medline Industries Inc.* vs *C.R Bard, Inc.*; Declaration of Barbara Weintraub Regarding Claim Construction; Civil Action No. 1:14-cv-03618; Judge John Z. Lee. Filed Jul. 8, 2016.
*Medline Industries Inc.* vs *C.R Bard, inc.*; Exhibit D to Declaration of Dylan J. Raife in Support of Bard Opening Claim Construction Brief. Civil Action No. 1:16-cv-03529; Judge Sharon Johnson Coleman; Filed Nov. 11, 2016.
*Medline Industries Inc.* vs *C.R Bard. Inc.*; Exhibit 1 to Declaration of Richard Meyst Regarding Claim Construction; Civil Action No. 1:14-cv-03618; Judge John Z. Lee; Filed Jul. 8, 2016.
*Medline Industries Inc.* vs *C.R. Bard, Inc.*, Exhibit 4 to C.R. Bard's LPR 2 3 Contentions; Civil Action No. 1:17-cv-7216; Judge Sara L. Ellis; Filed Jan. 16, 2018.
*Medline Industries Inc.* vs*C.R. Bard, Inc.*, Declaration of Peter Sauer in Support of Medline's Motion to Supplement Record; Civil Action No. 1:14-cv-03618; Judge John Z. Lee; Filed Mar. 23, 2017.
*Medline Industries Inc.* vs*C.R. Bard, Inc.*; Exhibit D lo Declaration of Kevin A. Lake; Civil Action No. 1:14-cv-03618. Judge John Z. Lee; Filed Jul. 8, 2016.
*Medline Industries Inc.* vs*C.R. Bard. Inc.*, Exhibit 1 to Declaration of Brian Eutermoser in Support of Medline Surreply; Civil Action No. 1:14-cv-03618; Judge John Z. Lee; Filed Sep. 7, 2016.
*Medline Industries Inc.* vs *C R. Bard, Inc.*; Exhibit B to Declaration ofNicole M. Smith; Civil Action No. 1:14~cv43618; Judge John Z. Lee; Filed Jun. 4, 2016.
*Medline Industries Inc.* vs *C R. Bard, inc.*; Exhibit D to Declaration of Nicole M Smith; Civil Action No. 1:14-cv-03618; Judge John Z. Lee; Filed Jun. 4, 2016.
*Medline Industries Inc.* vs *C R. Bard, Inc.*; Exhibit E to Declaration of Nicole M. Smith; Civil Action No, 1:14-cv-03618: Judge John Z. Lee; Filed Jun. 4, 2016.
*Medline Industries Inc.* vs *C R. Bard, Inc.*; Exhibit F to Declaration of Nicole M. Smith; Civil Action No. 1:14-cv-03618; Judge John Z. Lee; Filed Jun. 4, 2016.
*Medline Industries Inc.* vs *C R. Bard, Inc*; C R. Bard's Opening Claim Construction Bnel; Civil Action No. 1:14-cv-03618; Judge John Z. Lee; Filed Jun. 4, 2016.
*Medline Industries Inc.* vs *C R. Bard, Inc*; C.R Bard's Motion for Leave to Add Counterclaims; Civil Action No. 1:17-cv-7216; Judge Sara L. Ellis; Filed Feb. 27, 2018.
*Medline Industries Inc.* vs *C R. Bard, Inc*; Declaration of Dylan Raife in Support of Motion for Leave to Add Counterclaims; Civil Action No. 1:17-cv-7216; Judge Sara L. Eliis; Filed Feb. 27, 2018.
*Medline Industries Inc.* vs *C R. Bard, Inc*; Exhibit C to Declaration of Dylan Raife in Support of Motion for Leave to Add Counterclaims; Civil Action No. 1:17-cv-7216; Judge Sara L. Ellis; Filed Feb. 27, 2018.
*Medline industries Inc.* vs *C R. Bard. Inc*; Exhibit 1 to C R. Bard's LPR 2.3 Contentions, Civil Action No. 1:17-cv-7216, Judge Sara L. Ellis. Filed Jan. 16, 2018.
*Medline Industries Inc.* vs *C.R Bard, Inc.*, Exhibit A to Declaration of Richard Meyst re Claim Construction: Civil Action No. 1:16-cv-03529: Judge Sharon Johnson Coleman; Filed Dec. 9, 2016.
*Medline Industries Inc.* vs *C.R Bard, Inc.*; Exhibit B lo Declaration of Nicole Smith in Support of Bard Reply to Medline Claim Construction Brief; Civil Action No. 1:16-cv-03529; Judge Sharon Johnson Coleman; Filed Jan. 27, 2017.
*Medline Industries Inc.* vs *C.R. Bard, Inc.*; Exhibit C to Declaration of Nicole M. Smith; Civil Action No. 1:14-cv-03618; Judge John Z. Lee; Filed Jun. 4, 2016.
*Medline Industries Inc.* vs *C.R. Bard, Inc*; Exhibit B to C R. Bard's LPR 2.3 Contentions; Civil Action No. 1:17-cv-7216; Judge Sara L. Ellis; Filed Jan. 16, 2018.
*Medline Industries, Inc.* vs *C.R. Bard, Inc*: Transcript of Proceedings—Claim Construction Hearing: Civil Action No. 1:14-cv-3618. Judge John Z. Lee; Dated Jan. 11, 2017.
*Medline Industries Inc.* vs *C.R Bard, Inc.* Bard Opening Claim Construction Brief; Civil Action No. 1:16-cv-03529; Judge Sharon Johnson Coleman; Filed Nov. 17, 2017.
Pothier, Andrew, "Non-Final Office Action", Canadian Application No. 2,837,289; dated Feb. 14, 2018.
Poon, Robert, "NonFInal OA", U.S. Appl. No. 15/803,383, filed Nov. 3, 2017; dated Mar. 7, 2018.
Poon, Robert, "NonFinal OA", U.S. Appl. No. 15/804,520, filed Nov. 6, 2017; dated Jan. 19, 2018.
*Medline Industries Inc.* vs *C.R. Bard, Inc.*; C R. Bard's Final LPR 2.3 Contentions; Civil Action No. 1:17-cv-7216; Judge Sara L. Ellis; Filed Jul. 24, 2018.
*Medline Industries Inc.* vs *C.R. Bard, Inc.*; Exhibit A—C. R. Bard's Final LPR 2.3 Contentions; Civil Action No. 1:17-cv-7216; Judge Sara L. Ellis; Filed Jul. 24, 2018.
*Medline Industries Inc.* vs *C.R. Bard, Inc.*; Exhibit B—C. R. Bard's Final LPR 2.3 Contentions; Civil Action No. 1:17-cv-7216; Judge Sara L. Ellis; Filed Jul. 24, 2018.
*Medline Industries Inc.* vs *C.R. Bard, Inc.*; Exhibit C—C. R. Bard's Final LPR 2.3 Contentions; Civil Action No. 1:17-cv-7216; Judge Sara L. Ellis; Filed Jul. 24, 2018.
*Medline Industries Inc.* vs *C.R. Bard, Inc.*; Exhibit D—C. R. Bard's Final LPR 2.3 Contentions; Civil Action No. 1:17-cv-7216; Judge Sara L. Ellis; Filed Jul. 24, 2018.
*Medline Industries Inc.* vs *C.R. Bard, Inc.*; Exhibit E—C. R. Bard's Final LPR 2.3 Contentions; Civil Action No. 1:17-cv-7216; Judge Sara L. Ellis; Filed Jul. 24, 2018.
*Medline Industries Inc.* vs *C.R. Bard, Inc.*; Exhibit F—C. R. Bard's Final LPR 2.3 Contentions; Civil Action No. 1:17-cv-7216; Judge Sara L. Ellis; Filed Jul. 24, 2018.
*Medline Industries Inc.* vs *C.R. Bard, Inc.*; Exhibit G—C. R. Bard's Final LPR 2.3 Contentions; Civil Action No. 1:17-cv-7216; Judge Sara L. Ellis; Filed Jul. 24, 2018.
*Medline Industries Inc.* vs *C.R. Bard, Inc.*; Exhibit H—C. R. Bard's Final LPR 2.3 Contentions; Civil Action No. 1:17-cv-7216; Judge Sara L. Ellis; Filed Jul. 24, 2018.
*Medline Industries Inc.* vs *C.R. Bard, Inc.*; Exhibit I—C. R. Bard's Final LPR 2.3 Contentions; Civil Action No. 1:17-cv-7216; Judge Sara L. Ellis; Filed Jul. 24, 2018.
*Medline Industries Inc.* vs *C.R. Bard, Inc.*; Exhibit J—C. R. Bard's Final LPR 2.3 Contentions; Civil Action No. 1:17-cv-7216; Judge Sara L. Ellis; Filed Jul. 24, 2018.
*Medline Industries Inc.* vs *C.R. Bard, Inc.*; Exhibit K—C. R. Bard's Final LPR 2.3 Contentions; Civil Action No. 1:17-cv-7216; Judge Sara L. Ellis; Filed Jul. 24, 2018.
*Medline Industries Inc.* vs *C.R. Bard, Inc.*; Exhibit L—C. R. Bard's Final LPR 2.3 Contentions; Civil Action No. 1:17-cv-7216; Judge Sara L. Ellis; Filed Jul. 24, 2018.
*Medline Industries Inc.* vs *C.R. Bard, Inc.*; Exhibit M—C. R. Bard's Final LPR 2.3 Contentions; Civil Action No. 1:17-cv-7216; Judge Sara L. Ellis; Filed Jul. 24, 2018.
*Medline Industries Inc.* vs *C.R. Bard, Inc.*; Exhibit N—C. R. Bard's Final LPR 2.3 Contentions; Civil Action No. 1:17-cv-7216; Judge Sara L. Ellis; Filed Jul. 24, 2018.

(56) References Cited

OTHER PUBLICATIONS

*Medline Industries Inc*. vs *C.R. Bard, Inc*.; Exhibit O—C. R. Bard's Final LPR 2.3 Contentions; Civil Action No. 1:17-cv-7216; Judge Sara L. Ellis; Filed Jul. 24, 2018.
*Medline Industries Inc*. vs *C.R. Bard, Inc*.; Exhibit P—C. R. Bard's Final LPR 2.3 Contentions; Civil Action No. 1:17-cv-7216; Judge Sara L. Ellis; Filed Jul. 24, 2018.
*Medline Industries Inc*. vs *C.R. Bard, Inc*.; Exhibit Q—C. R. Bard's Final LPR 2.3 Contentions; Civil Action No. 1:17-cv-7216; Judge Sara L. Ellis; Filed Jul. 24, 2018.
*Medline Industries Inc*. vs *C.R. Bard, Inc*.; Exhibit R—C. R. Bard's Final LPR 2.3 Contentions; Civil Action No. 1:17-cv-7216; Judge Sara L. Ellis; Filed Jul. 24, 2018.
*Medline Industries Inc*. vs *C.R. Bard, Inc*.; Exhibit S—C. R. Bard's Final LPR 2.3 Contentions; Civil Action No. 1:17-cv-7216; Judge Sara L. Ellis; Filed Jul. 24, 2018.
*Medline Industries Inc*. vs *C.R. Bard, Inc*.; Exhibit T—C. R. Bard's Final LPR 2.3 Contentions; Civil Action No. 1:17-cv-7216; Judge Sara L. Ellis; Filed Jul. 24, 2018.
Ortega, Rafael et al., "Female Urethral Catheterization", N. Engl. J. Med vol. 358:e15; published 2008.
Poon, Robert, "Appeal Decision", U.S. Appl. No. 12/647,515, filed Dec. 27, 2009; dated Jan. 19, 2018.
Poon, Robert, "Appeal Decision", U.S. Appl. No. 14/265,920, filed Apr. 30, 2014; dated Aug. 1, 2018.
Thomsen, Todd, "Male Urethral Catheterization", N. Engl. J. Med vol. 354:e22; Published 2006.

* cited by examiner

STACKED CATHETER TRAY, SYSTEM, AND ASSOCIATED METHODS

CROSS REFERENCE TO PRIOR APPLICATIONS

This application is related to commonly assigned, co-pending U.S. application Ser. No. 12/495,148, Filed Jun. 30, 2009, entitled "Catheter Tray, Packaging System, and Associated Methods," which is incorporated herein by reference.

BACKGROUND

Technical Field

This invention relates generally to storage containers for medical devices, and more particularly to a stacked storage container for a long, flexible medical implement, such as a catheter, that can be unstacked and arranged in a side-by-side relationship.

Background Art

Medical devices, including surgical instruments, supplies, and so forth, are generally shipped from manufacturer to medical services provider in sterile packaging. For example, a scalpel may be shipped to a surgeon in a plastic, vacuum-sealed, sterile package. Similarly, bandages may be shipped in paper, plastic, or paper composite sterile wrappers. When the medical services provider is ready to use the medical supply, the sterile package is removed. The medical services provider then uses the object in accordance with the procedure being performed.

While conventional packaging works well for objects having a generally unchanging form factor, special considerations have to be taken into consideration for some medical supplies. By way of example, catheter assemblies and other flexible equipment is generally shipped in a coiled configuration in cardboard packaging. Once the sterile packaging is removed, the catheter must be uncoiled prior to use. Care must be taken in shipping, unwrapping, and using the catheter. For instance, if a catheter is inadvertently bent, kinked, or otherwise damaged, it may no longer be suitable for use. Compounding this issue, catheters are available in a variety of lengths ranging from 100 centimeters to over 250 centimeters.

There is thus a need for an improved container for flexible medical devices or catheters that facilitates more effective and simpler deployment of the device during a procedure.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
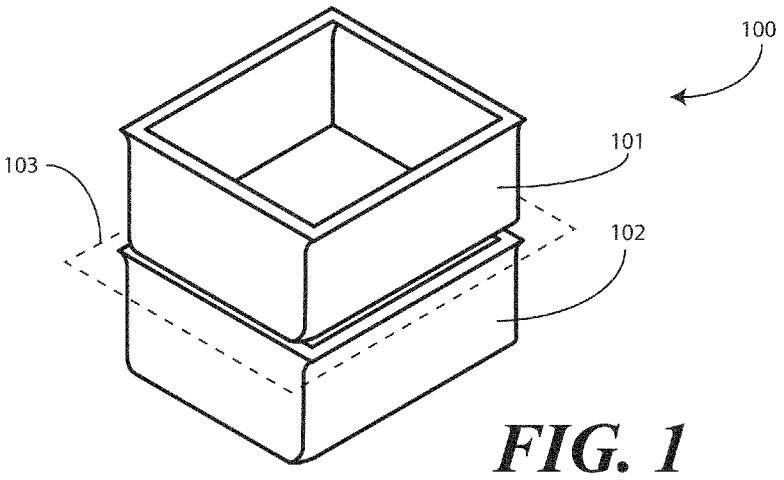
FIG. 1 illustrates one example of a stacked catheter tray in accordance with one embodiment of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE INVENTION

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion.

For example, talking about a device (10) while discussing figure A would refer to an element, 10, shown in figure other than figure A.

Embodiments of the present invention provide a tray assembly, or kit, for medical use, such as in catheterization procedures, which can be shipped as a two-layer tray stack with a first tray being disposed atop a second tray. A medical services provider, when deploying the tray, may unstack the trays and arrange them in a side-by-side, single layer catheter tray assembly. In one embodiment, mechanical or other features are configured to retain the first tray adjacent to the second tray when in the side-by-side, single layer configuration such that the configuration is unitary.

One or more trays in the two-layer tray stack can be configured to accommodate a coiled medical device such as a catheter or catheter assembly. In addition to accommodating the coiled medical device, embodiments of the present invention are also configured to contain devices and materials intended for use with the coiled medical device. For example, medical implements for use in the catheterization procedure may be disposed within the trays. Examples of such implements include a catheter assembly, a drain bag, one or more syringes that contain substances such as sterile water or lubricating jelly, swab sticks, specimen containers, sterile drapes such as underbuttocks drapes and fenestration drapes, hand sanitizer packages, instruction manuals, and so forth.

In one embodiment, the trays are configured such that when they are arranged in the side-by-side, single layer assembly, the implements disposed within the tray are arranged in a predetermined sequence corresponding to an order of use during a catheterization procedure. Further, the trays are configured such that they can be placed within the sterile field created about the patient. In one embodiment, one of the trays includes a well within which the catheter is contained. Accordingly, the catheter always remains within the sterile field, thereby reducing the chance that the field will be contaminated. For example, if the medical services provider or patient inadvertently bumps the tray containing the catheter, the well will continue to hold the catheter within the sterile field. When the medical services provider finds the implements in the pre-arranged in order of use, each implement can be easily accessed without ever needing to leave the sterile field.

When such an arrangement is employed, embodiments of the present invention offer advantages over prior art trays, in that procedure consistency is enhanced. Said differently, prior art trays with randomly arranged implements can lead to inconsistent procedure techniques. In a first procedure, a person may lube the catheter tube first and then place a drape over the patient, while these steps may occur in the opposite order in a second procedure, and so forth. By contrast, with embodiments of the present invention, when the implements are arranged in a predetermined order that depends upon order of use, medical service providers are encouraged to perform procedures more consistently.

Another advantage offered by embodiments of the present invention is increased preservation of the sterile field about the patient. Some prior art trays are so large that it is not possible to keep them within the sterile field during a catheterization procedure. Further, there is no means of keeping the catheter within prior art trays. Embodiments of the present invention, by contrast, easily fit within the sterile field, as will be shown below. Further, embodiments of the present invention reliably retain the catheter within the tray.

In one embodiment, the trays are configured in a unique geometric shape so as to fit between a catheterization patient's legs. For example, as will be shown below, the trays can be configured as trapezoids of differing sizes so as to form a large trapezoid when arranged in the side-by-side, single layer configuration. Other shapes and curves can be used as well. This configuration provides easy access to the implements stored therein during a procedure.

Embodiments of the present invention offer advantages over prior art catheter tray assemblies. For example, where the trays are configured to fit between a patient's legs, embodiments of the present invention make it simpler to maintain a sterile field, as the trays, patient, and implements may all be kept in close quarters about the procedure site. Further, in one embodiment the tray can be configured to fit atop a sterile underbuttocks drape to make it even easier to maintain a sterile field. By contrast, prior art tray systems required that a medical services provider place trays far from the procedure site. The medical services provider was then required to walk about the room during the procedure to reach the various implements, thereby increasing the probability that the sterile field would be contaminated.

In one embodiment of the invention, each tray includes one or more openings in a tray wall. When the trays are arranged in the single layer, side-by-side configuration, the openings can be configured to align such that a tube connected to a catheter assembly can be passed therethrough. In such a configuration, the catheter assembly can be stored in a first tray. The second tray can then be used as a well, such as for lubricating the tube. A user may dispense lubricating jelly in the second tray and then pass the tubing from the first tray to the second tray through the opening. This allows the user to lubricate the tube while maintaining sterility because the tube is never removed from the confines of the tray. As such, trays in configured in accordance with embodiments of the present invention have multi-purpose functionality. They store devices for transport, and can also be used during the procedure. This functionality is not possible with many prior art trays.

Figure 2:
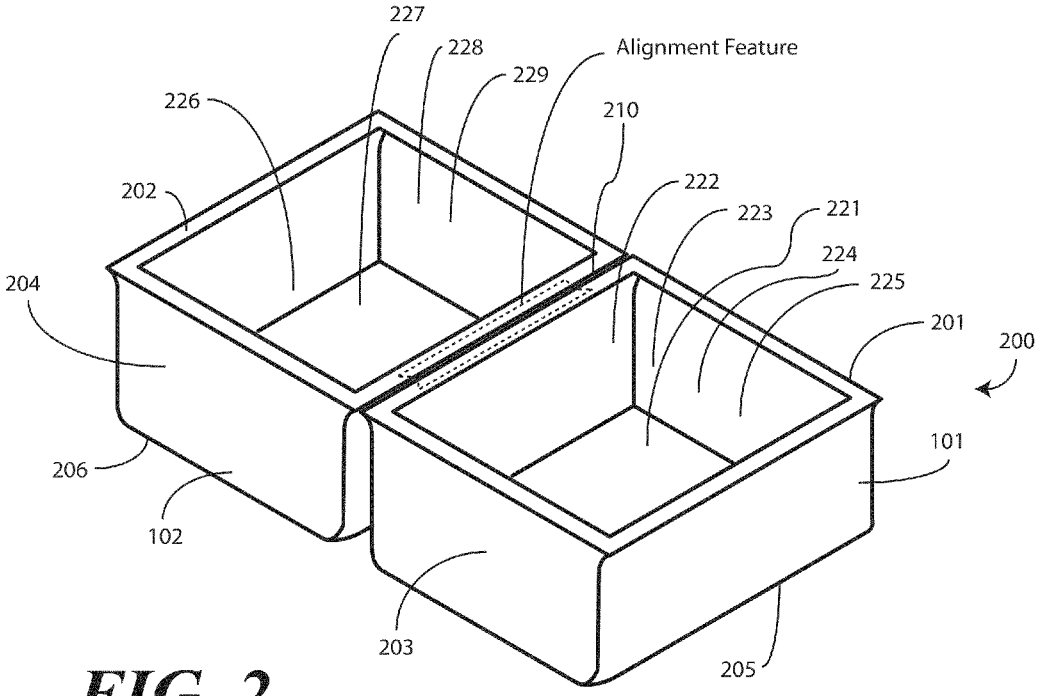
FIG. 2 illustrates the example of FIG. 1 having been unstacked and configured in a side-by-side arrangement as a unitary, single layer catheter tray assembly in accordance with embodiments of the invention.

Turning now to FIGS. 1 and 2, illustrated therein is one embodiment of a tray assembly configured to accommodate a catheter assembly and medical devices corresponding to catheter use in accordance with embodiments of the invention. FIGS. 1 and 2 illustrate a first tray 101 and a second tray 102. Each tray includes an opening, sidewalls, and a base member. For example, the first tray 101 includes a first tray opening 201, a first tray sidewall 203, and a first tray base member 205. Similarly, the second tray 102 includes a second tray opening 202, a second tray sidewall 204, and a second tray base member 206.

As will be shown below, in one embodiment, one or more of the first tray base member 205 or the second tray base member 206 may be contoured in accordance with a predetermined pattern suitable for supporting implements stored within the trays, or suitable for assisting a medical services provider during a catheterization procedure. Additionally, as will be shown below, either tray may include barriers that define compartments within the tray.

The first tray 101 and second tray, whether contoured or simple, and whether including barriers and compartments or not, can be manufactured in various ways. For example, in one embodiment, the first tray 101 and second tray 102 can be thermally formed on a mold from a soft thermoplastic, such as styrene or polystyrene. In another embodiment, the first tray 101 and second tray 102 can be injection molded. In another embodiment, the trays can be poured on a mold using a quick setting plastic, epoxy, or resin. Other methods of manufacture will be obvious to those of ordinary skill in the art having the benefit of this disclosure.

The first tray 101 and second tray 102 can be manufactured from the same material or different materials. For example, some applications may require one tray to be manufactured from a more durable or stronger material than the other. Accordingly, one tray can be manufactured from a soft thermoplastic, such as polystyrene, while the other tray is manufactured from a rigid thermoplastic, such as polycarbonate.

The first tray 101 and the second tray 102 can be of the same size or of different sizes. As is described below, in one configuration the trays are stacked atop each other to form a tray stack or a stacked tray assembly. Where the first tray 101 and second tray 102 are the same size, a separator layer 103, which may be made from plastic, cardboard, or other similar materials, may be placed between the trays when in the stacked configuration.

In one embodiment, exemplary dimensions for one or more of the trays are as follows: The length 112 can be between nine and twelve inches, such as ten inches. One illustrative length 112 may be 10.380 inches. Similarly, the width 113 can be between eight and eleven inches, such as nine inches. One illustrative width 113 is 9.250 inches. The height 114 can be between one and three inches. One illustrative height 114 is 1.750 inches.

In FIG. 1, the first tray 101 is placed atop the second tray 102, with the first tray base member 205 disposed above the second tray opening 201, so as to form a tray stack 100. This configuration is suitable for shipping from a manufacturer to an end user. This configuration is also suitable for storage, such as within a hospital or healthcare facility, as the tray stack 100 occupies less storage surface area than would multiple trays. As will be shown below, the tray stack can be shipped as a single wrapped assembly. This configuration permits all of the necessary catheterization implements to be stored within the trays without the need of shipping multiple packages.

In FIG. 2, the first tray 101 and second tray 102 have been unstacked. The first tray 101 and second tray 102 have been placed in a side-by-side, single layer catheter tray assembly 200. As will be shown below, in various embodiments the trays can include mechanical devices configured to secure the first tray 101 and second tray 102 together as an integral, unitary unit when arranged in this configuration. In one embodiment, the first tray 101 and second tray 102 are configured such that the interfacing edges 210 align in only one side-by-side configuration, thereby ensuring that a user properly aligns the trays, rotationally and ordinally, when creating the side-by-side, single layer catheter tray assembly 200.

In one embodiment, the implements disposed within the first tray 101, and the implements disposed within the second tray 102, are arranged in a predetermined sequence corresponding to an order of use during a catheterization procedure. In one embodiment, when the first tray 101 and the second tray 102 are arranged as the side-by-side, single layer catheter tray assembly 200, the implements in each tray are arranged such that the sequence flows in accordance with the order of use from one tray to the next. For example, a medical services provider may start from the right of the first tray 101 using implements and proceed to the left, drawing each implement as it is needed. When the medical services provider completes usage of the implements in the first tray, they arrive at the right side of the second tray 102 and continue proceeding leftward. While the direction is not important, some embodiments of the invention are configured such that when the first tray 101 and second tray 102 are arranged in the side-by-side, single layer catheter tray assembly 200, the implements disposed therein are arranged uni-directionally in accordance with order of use.

Note also that the direction can include up and down as well. Some components, such as the catheter assembly are quite large. As such, it may not be convenient for a manufacturer to align the catheter assembly in a side-by-side arrangement with the other components. Accordingly, the catheter assembly and drain bag may be placed in the bottom of a tray. Other implements may then be arranged atop the catheter assembly and drain bag. Still other implements can be placed atop the trays. Thus, a medical services provider may start, for example, at the top of the first tray 101 drawing implements. Once the top components are removed, the medical services provider may move from right to left drawing implements from the second layer, which is followed by working down into the first tray 101. Once the first tray implements have been used, the medical services provider may proceed in similar fashion with the second tray. Other directional schemes, with different directional changes but still with a sequential usage relationship of implements, will be obvious to those of ordinary skill in the art having the benefit of this disclosure.

This concept is better illustrated by example. In one illustrative embodiment, the first tray 101 and second tray 102 are configured to hold or otherwise accommodate all of the necessary devices and materials to perform a catheter-based procedure on a patient. Said differently, the first tray 101 and second tray 102 are configured to hold not only the catheter assembly, but the medical devices corresponding to catheter use as well. Using one illustrative procedure as an example, the following devices will be used: a syringe holding sterile water, a syringe holding lubricating jelly or another equivalent lubricant, a catheter assembly, skin cleansing or preparation materials, and a specimen jar. Additional objects can be included with the tray, such as one or more towels, a drape to cover the patient, rubber gloves, hand sanitizing materials, swab sticks, a securement device, a Foley insert tag, a printed instruction pamphlet, and so forth. Further, subsets of these objects may be included.

For the purposes of the example, presume that the following implements are disposed within the tray stack: Disposed within the first tray 101 are instructions for using the implements, an underbuttocks drape, hand sanitizer, swab sticks, latex gloves, and a fenestrated drape. Disposed within the second tray 102 are a syringe containing sterile water, a syringe containing lubricating jelly, a catheter assembly, and a specimen jar.

The implements may be disposed within each of the first tray 101 and the second tray 102 with the following predetermined arrangement. In the first tray 101, the fenestrated drape may be disposed at the bottom of the first tray 101 adjacent to the first tray base member 205 at location 221. Moving from left to right above the fenestrated drape location 221, the swab sticks may be disposed at a left-most location 222. Next, latex gloves may be disposed at location 223. The hand sanitizer may be disposed at location 224. Next, the underbuttocks drape may be disposed at location 225. Atop the layer formed by locations 222, 223, 224, 225, the instructions may be disposed.

In the second tray 102, the specimen jar may be disposed in the bottom of the second tray in a left-most location 226. Slightly to the right, the catheter assembly may be disposed at location 227. Atop the catheter assembly, and toward the left, the lubricating jelly syringe may be disposed at location 228. To the right, the sterile water syringe may be disposed at location 229.

When configured as the tray stack 100, the first tray 101 can be placed atop the second tray 102, perhaps with a separator layer 103 therebetween. The tray stack 100 can be shipped from the manufacturer in this configuration. Additionally, it can be stored in this configuration.

When a medical services provider is ready to use the tray stack 100, they first remove any sterile wrap that may be disposed about the tray stack. Where the sterile wrap is a sealed bag, this step can include unsealing the sealed bag, breaking through the bag, or breaking the thermal seal. Where the bag is sealed with an adhesive or other type of seal, such as one including pull-tabs, this step can include pulling the pull-tabs or separating the adhesive seal.

The medical services provider then unstacks the trays and places them in the side-by-side, single layer catheter tray assembly 200. As the instructions are atop the first tray 101, the medical services provider knows to initially draw the instructions from the side-by-side, single layer catheter tray assembly 200, as the medical services provider will see the instructions first.

The medical services provider then begins working right to left in the first tray 101. Accordingly, the next step would be to remove the underbuttocks drape from location 225 and places the underbuttocks drape beneath the patient. The medical services provider then withdraws the hand sanitizer from location 224 and cleans their hands. The medical services provider then withdraws the gloves from location 223 and dons them. The medical services provider may then withdraw the swab sticks from location 222 may cleanse the patient. The medical services provider may then withdraw the fenestrated drape from location 221 and place it atop the patient.

The medical services provider then moves to the second tray 102 to continue the process and to prepare the catheter. The medical services provider may withdraw the syringes from locations 229,228. In one embodiment, the medical services provider then dispenses the lubricating jelly from one syringe into the first tray 101. The medical services provider then withdraws a portion of the catheter assembly from location 226 and fills a test balloon of the catheter assembly with water from a syringe obtained from location 229. As lubricating jelly has been dispensed into the first tray 101, this tray can be used to lubricate tubing of the catheter assembly. Specifically, the medical services provider can pass at least a portion of the catheter assembly from the second tray 102 to the first tray 101, thereby causing the portion of the catheter assembly to pass through the lubricating jelly. The medical services provider may then insert the catheter and secure the drain bag to the catheter assembly, using the specimen jar where required. Note that this is just one example of many that will be obvious to those of ordinary skill in the art having the benefit of this disclosure when the various components are rearranged in accordance with different procedural steps.

Figure 3:
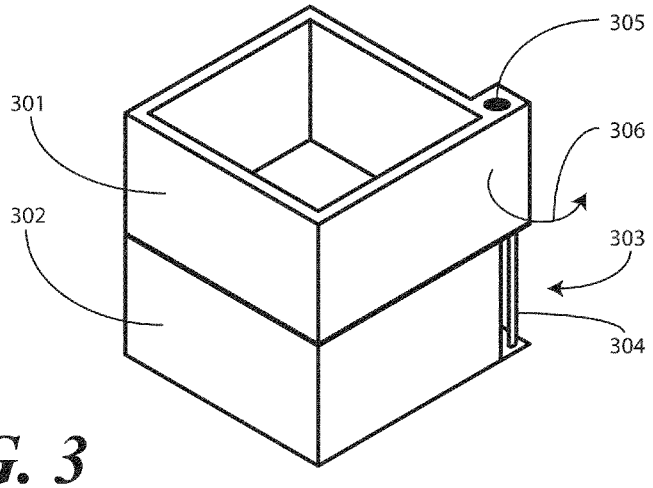
FIG. 3 illustrates another example of a stacked catheter tray in accordance with another embodiment of the invention.

Turning now to FIG. 3, illustrated therein is another tray assembly 300 configured to accommodate a catheter assembly and medical devices or implements corresponding to catheter use in accordance with embodiments of the invention. As with FIGS. 1 and 2, the tray assembly 300 includes two trays, a first tray 301 and a second tray 302. Rather than being arranged in a simple stacked structure, the embodiment of FIG. 3 further includes a mechanical coupling 303 connected between the first tray 301 and the second tray 302. The mechanical coupling 303 is configured to permit the first tray 301 and the second tray 302 to transition from the two layer, stacked configuration of FIG. 3 to the single layer, side-by-side configuration 400 shown in FIG. 4. As with FIGS. 1 and 2, when the first tray 301 and second tray 302 are arranged in the single layer, side-by-side configuration 400, implements associated with the catheterization procedure can be disposed therein in a predetermined sequence corresponding to an order of use during a catheterization procedure as described above.

Figure 4:
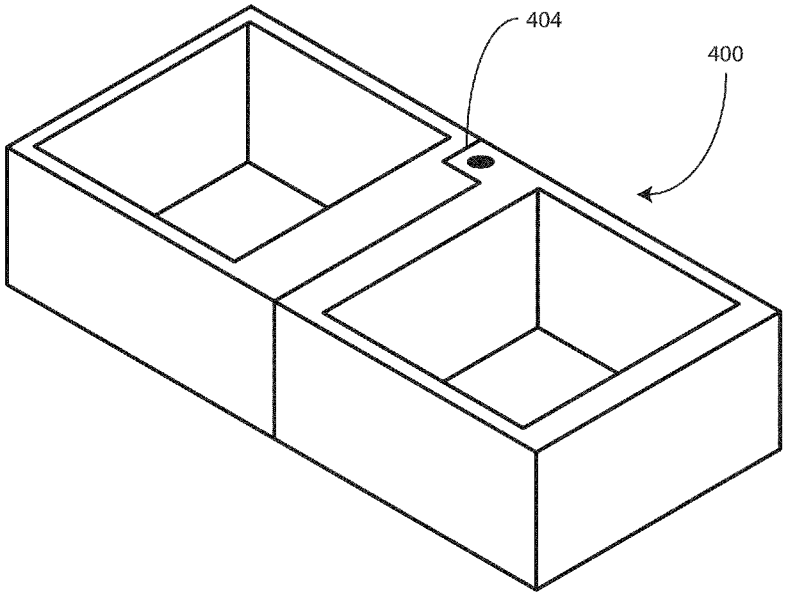
FIG. 4 illustrates the example of FIG. 3, in which the top tray has been rotated about a post and slid theredown so as to form a side-by-side, unitary single layer catheter tray assembly in accordance with embodiments of the invention.

In the embodiment of FIGS. 3 and 4, as with the embodiments of FIGS. 1 and 2, the mechanical coupling 303 is configured to permit the first tray 301 and second tray 302 to transition from the two-layer stacked configuration 300 to the single layer, side-by-side configuration without inversion of either the first tray 301 or the second tray 302. In the embodiment of FIGS. 3 and 4, this is accomplished with a pivot and slide mechanism comprising a post 304 and notch 404 assembly.

The post 304, which extends from the second tray 302, fits into a corresponding aperture 305 disposed in the first tray 301. The notch 404, as shown in FIG. 4, is asymmetrical such that when the trays are in the two layer, stacked configuration 303 the notches will not engage, thereby keeping the first tray 301 above the second tray 302. However, when the first tray 301 is rotated 306 relative to the second tray 302, the notch 404 engages, thereby permitting the rod 304 to slide into the aperture 305. Once the sliding process is complete, the single layer, side-by-side configuration 400 of FIG. 4 is achieved.

The mechanical coupling 303 of FIGS. 3 and 4 serves a dual purpose. In addition to permitting translation from a stacked configuration to a side-by-side configuration, the mechanical coupling 303 further works to hold the first tray 301 and second tray 302 together when in the single layer, side-by-side configuration 400. Said differently, the mechanical coupling 303 serves as a retention mechanism configured to selectively retain the first tray 301 and the second tray 302 together in the singe layer, side-by-side configuration 400.

Figure 5:
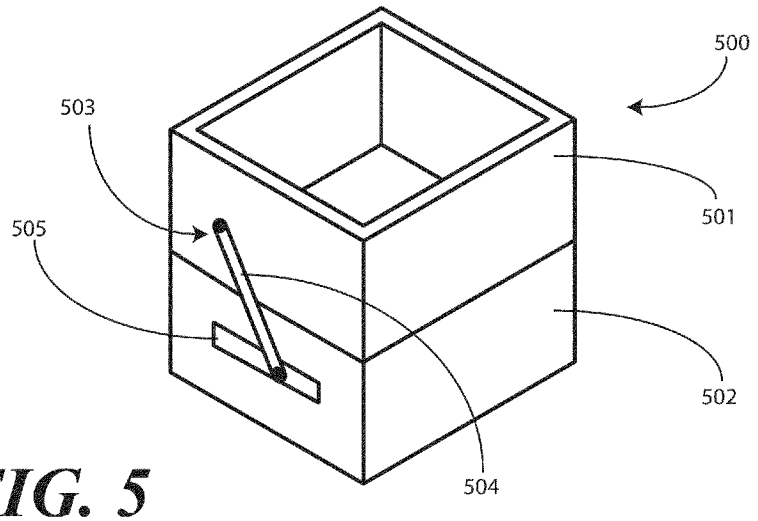
FIG. 5 illustrates another embodiment of a stacked catheter tray assembly in accordance with another embodiment of the invention.
Figure 6:
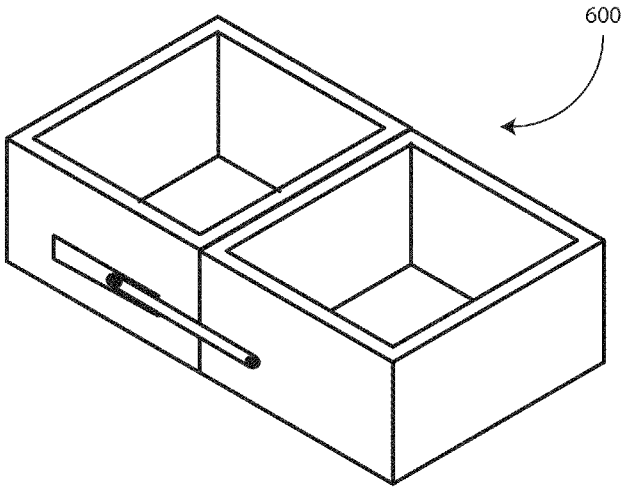
FIG. 6 illustrates the example of FIG. 5 having translated to a side-by-side configuration without inversion of either tray for a catheterization procedure in accordance with embodiments of the invention.

Turning now to FIGS. 5 and 6 illustrated therein is another tray assembly having a mechanical coupler 503 in accordance with embodiments of the invention. The tray assembly includes a first tray 501 and a second tray 502. As shown in FIG. 5, the first tray 501 and second tray 502 may be configured in a two-layer, stacked configuration 500.

The mechanical coupler 503 in this embodiment is a link 504 and track 505 mechanism that permits the first tray 501 to translate relative to the second tray 502 to form the single layer, side-by-side configuration 600 shown in FIG. 6. To make the translation, a user first moves the first tray 501 in a first direction 506, thereby causing the links 504 to move within the track 505. The user then moves the first tray 501 in a second direction 507, thereby causing the links 504 to pivot. The resulting single layer, side-by-side configuration 600 is shown in FIG. 6. As with FIGS. 3 and 4, the embodiment of FIGS. 5 and 6 permits the first tray 501 and second tray 502 to transition from the two-layer, stacked configuration 500 to the single layer, side-by-side configuration 600 without inversion of either the first tray 501 or the second tray 502.

Figure 7:
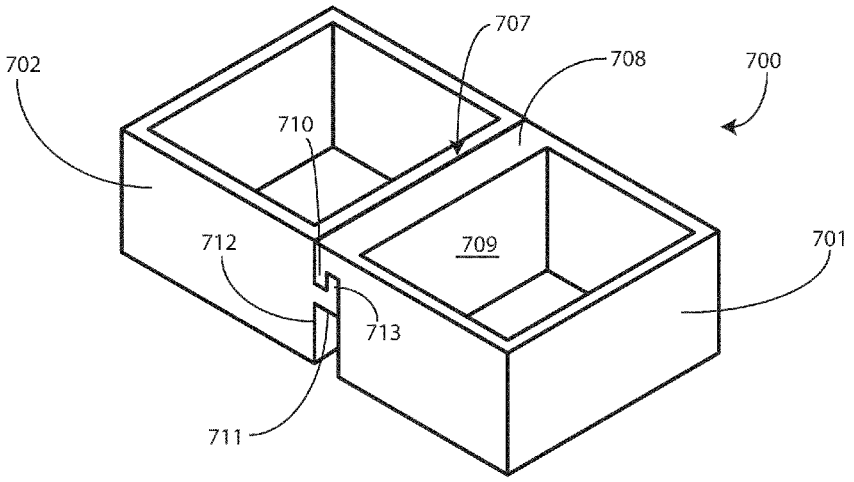
FIG. 7 illustrates a two-tray catheter tray assembly having a retention mechanism configured to retain the first tray and second tray in the single layer, side-by-side configuration in accordance with embodiments of the invention.

Turning now to FIG. 7, illustrated therein is a single layer, side-by-side configuration 700 employing an alternate retention mechanism 707. As with FIGS. 5 and 6, the retention mechanism 707 is configured to couple the first tray 701 and the second tray 702 together when arranged as a side-by-side, single layer catheter tray assembly.

In the embodiment of FIG. 7, the retention mechanism 707 comprises a first hook ledge 708 extending from a first tray sidewall 709. The first hook ledge 708 terminates in a first hook 710 that extends substantially orthogonally from the first hook ledge 708.

A corresponding second hook ledge 711 extends from a second tray sidewall 712. The second hook ledge 711 terminates in a second hook 713 that extends substantially orthogonally from the second hook ledge 712.

The first hook ledge 708 and second hook ledge 711, in this illustrative embodiment, are configured in a complementary fashion such that each engages the other to couple the first tray 701 and second tray 702 together when arranged as the side-by-side, single layer catheter tray assembly shown in FIG. 7.

Figure 8:
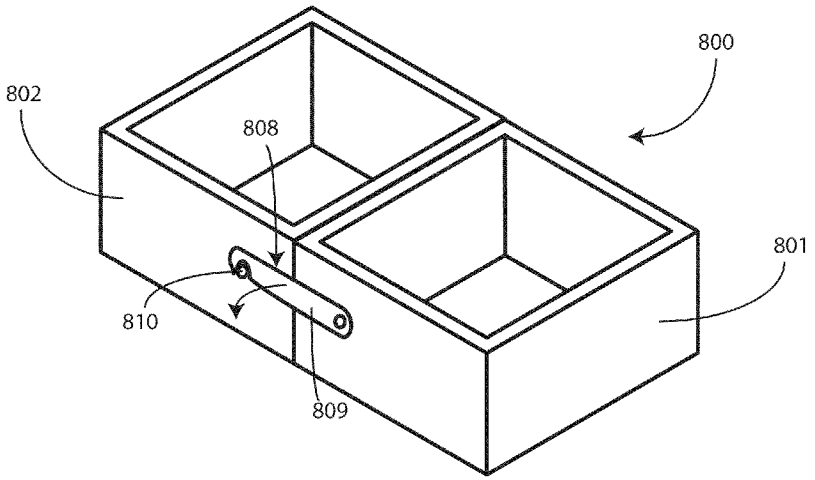
FIG. 8 illustrates another two-tray catheter tray assembly having another retention mechanism configured to retain the first tray and the second tray together in the single layer, side-by-side configuration in accordance with embodiments of the invention.

Turning now to FIG. 8, illustrated therein is another is a single layer, side-by-side configuration 800 employing an alternate retention mechanism 808. As with FIG. 7, the retention mechanism 808 is configured to couple the first tray 801 and the second tray 802 together when arranged as a side-by-side, single layer catheter tray assembly.

In the embodiment of FIG. 8, the retention mechanism 808 comprises one or more arm hinges 809 that pivot and couple to one or more pins 810. It will be clear to those of ordinary skill in the art having the benefit of this disclosure that additional retention mechanisms can be substituted for the retention mechanism 808 of FIG. 8. For example, retention mechanisms as simple as rubber bands or other wraps about the first tray 801 and second tray 802 can be used to retain the trays together as a side-by-side, single layer catheter tray assembly. Alternatively, snaps, hook and latch devices, lathes, or other mechanical features can be used.

Figure 9:
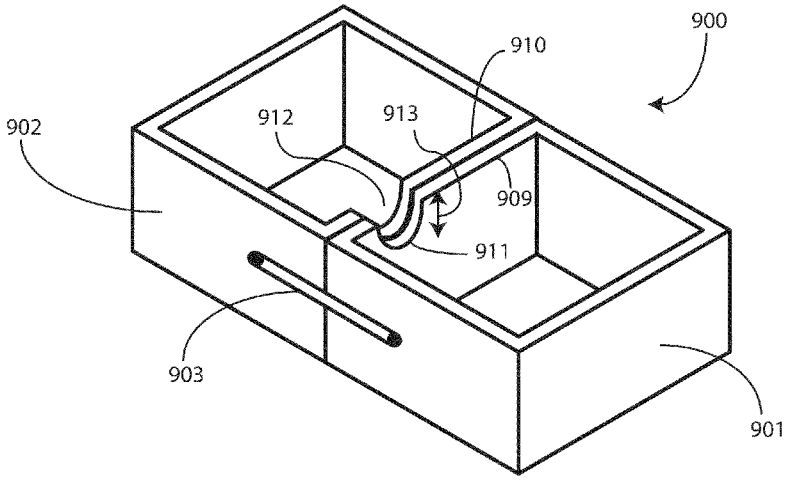
FIG. 9 illustrates another two-tray catheter tray assembly having openings in the sidewalls of each tray such that tubing corresponding to a catheter assembly can pass from a storage tray to a well tray to be lubricated prior to a catheterization procedure in accordance with embodiments of the invention.

Turning now to FIG. 9, illustrated therein is another tray assembly configured in accordance with embodiments of the invention. As with previous embodiments, the embodiment of FIG. 9 includes a first tray 901 and a second tray 902. Each tray includes an opening, sidewalls, and a base member. The first tray 901 can be placed atop the second tray 902, with the first tray base member disposed above the second tray opening so as to form a tray stack.

The first tray 901 and second tray 902 can then be unstacked to form a side-by-side, single layer catheter tray assembly 900. The trays can include mechanical features 903 that are configured to permit the first tray 901 to translate relative to the second tray 902 to form the single layer, side-by-side configuration 900. The mechanical feature 903, or optionally an additional retention mechanism, can further be used to retain the trays together as the single layer, side-by-side configuration 900.

In the embodiment of FIG. 9, a first tray sidewall 909 defines an opening 911 therein. Similarly, the second tray sidewall 910 defines an opening 912 therein. In one embodiment, the openings 911,912 are complementary such that they align with each other when the first tray 901 and the second tray 902 are placed in the single layer, side-by-side configuration 900. As described above, in one embodiment the first tray 901 can be used as a lubrication well for a catheter assembly disposed within the second tray 902. This complementary opening alignment permits a medical services provider to pass tubing coupled to the catheter assembly through the openings during the lubrication process. To help preserve the integrity of the sterile field about the trays, in one embodiment the openings 911,912 have a depth 913 sufficient to permit a tubing member of the catheter assembly to pass therethrough from the second tray 902 to the first tray 901.

Figure 10:
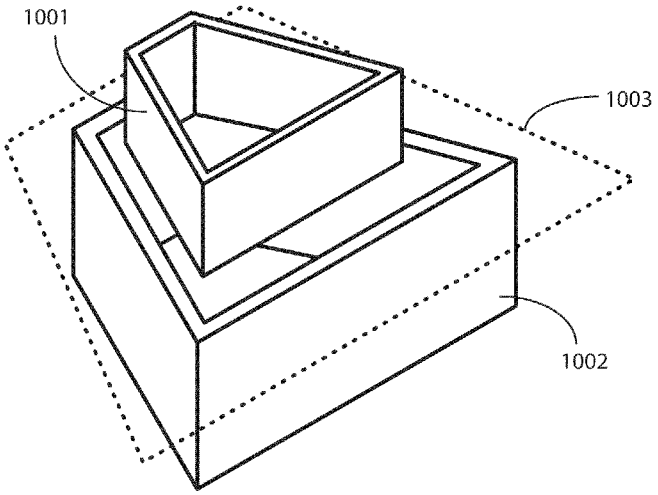
FIG. 10 illustrates a trapezoidal configuration of a stacked tray assembly in accordance with one embodiment of the invention.

Turning now to FIG. 10, illustrated therein is another stacked tray assembly configured in accordance with one embodiment of the invention. As with previous embodiments, the embodiment of FIG. 10 includes a first tray 1001 and a second tray 1002. Each tray includes an opening, sidewalls, and a base member. The first tray 1001 can be placed atop the second tray 1002, with the first tray base member disposed above the second tray opening so as to form a tray stack. An optional separator layer 1003 may be placed therebetween. In one embodiment a rim, fingers or the like in the second try 1002 may be configured to support the first tray 1001. Catheterization elements can be disposed within the trays, and in one embodiment are disposed in a predetermined sequence corresponding to an order of use during a catheterization procedure.

For example, a sequence may be that a catheter, catheter tubing and a drain bag may be located in the second tray 1002 and at least one syringe may be located in the first tray. In this sequence (or order), once the trays are un-stacked, the catheter assembly is further away from the patient, and the first tray, which is the preparation tray is closes to the patient. When the kit is opened, the trays are at least partially un-stacked or placed in a single layer or plane, such that the catheter may be positioned across the two trays 1001, 1002 for testing and lubrication, while connected to the tubing and drain bag. As the caregiver moves through the procedure the catheter is drawn towards the patient from the second tray 1002 to the first tray 1001, for preparation and to the patient for insertion.

Further, in the first tray 1001 in this embodiment, are the hand antiseptic and the gloves which are accessible from the top of the tray upon removing the sterile barrier wrap. In another embodiment, the gloves and the antiseptic are enclosed with the folds of the sterile wrap such that during the unfolding or unwrapping, the gloves are accessible prior to the complete unwrapping the trays, 1001, 1002.

Other procedure related items including cleaning swabs, iodine swab sticks for example, specimen containers, tubing securement devices, tags (e.g. foley intertag) that attach to the tubing and the like are also stored in the second tray. In one embodiment the swabsticks are placed substantially on top of the drain bag and within the coils of tubing. The catheter may be on top of the swabsticks as it may be prepared prior to using the swab sticks to cleanse the patient. In another embodiment, a secondary container with the second tray holds at least some of the procedure related items.

During the procedure, the catheter, or at least a portion thereof may be drawn from the second tray 1002 to the first tray 1001 and placed in the first tray 1001, tested and lubricated such that the first tray 1001 catches retains the residual lubrication fluids. The other portions of the catheter assembly including the tubing and a drain bag for example, remain in the second tray 1002 at least during the preparation and insertion of the catheter. After preparation of the catheter, the catheter is drawn from the first tray and inserted into the patient. The syringe in one embodiment may be mounted in the first tray in a configuration that allows the lubrication jelly to be dispensed onto the catheter, or the catheter tested, or both, while in the first tray 1001.

Figure 11:
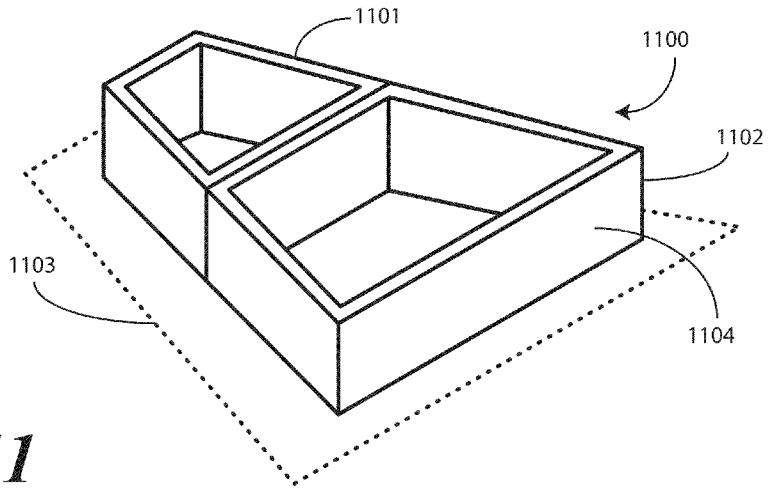
FIG. 11 illustrates the embodiment of FIG. 10 having been unstacked and configured as a single layer, side-by-side configuration forming a trapezoidal shape suitable for being placed between a catheterization patient's legs in accordance with embodiments of the invention.

In the embodiment of FIG. 10, each of the first tray 1001 and second tray 1002 are trapezoidal in shape. In this illustrative embodiment, the first tray 1001 is smaller than the second tray 1002 in size. The first tray 1001 and second tray 1002 are configured such that when the first tray 1001 and second tray 1002 are unstacked and placed side-by-side, as shown in FIG. 11, they form a trapezoid 1100 having a perimeter 1111 defined by the first tray sidewalls 1103 and second tray sidewalls 1104. Retention devices, such as those described above, can be included to selectively interlock the first tray 1001 to the second tray 1002 when they are unstacked and placed side-by-side to form the trapezoid 1100.

Figure 12:
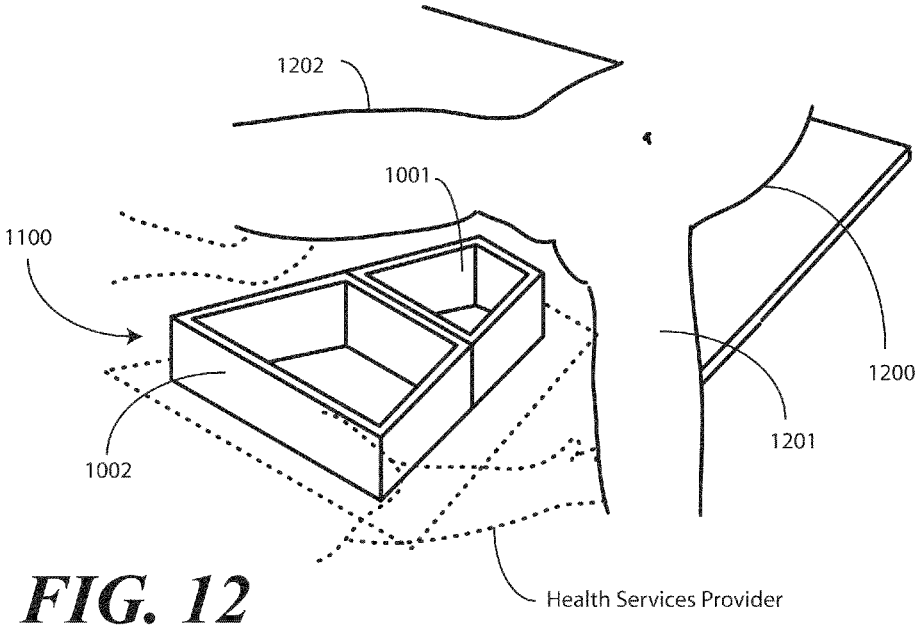
FIG. 12 illustrates the embodiment of FIG. 11 being used with a patient.

In one embodiment, the trapezoid 1100 is configured so as to fit between the legs of a patient as shown in FIG. 12. In FIG. 12, the first tray 1001 and second tray 1002 have been selectively interlocked to form the resulting trapezoid 1100. The trapezoid 1100 has dimensions suitable for fitting between the legs 1201,1202 of a patient 1200.

While trapezoids are used herein as an illustrative embodiment suitable for fitting within the legs 1201,1202 of a patient 1200, it will be clear to those of ordinary skill in the art having the benefit of this disclosure that embodiments of the invention are not so limited. Other shapes, including triangles, arches, semicircles, parabolic shapes, and the like, each suitable for fitting between the legs 1201,1202 of a patient 1200, can be substituted. By having a side-by-side, single layer catheter tray assembly suitable for placement between the legs 1201,1202 of a patient 1200, a medical services provider has full access to all the necessary implements required during a catheterization procedure without having to move about. This ease of access reduces the probability of contaminating the sterile field between the legs 1201,1202 of the patient 1200.

Figure 13:
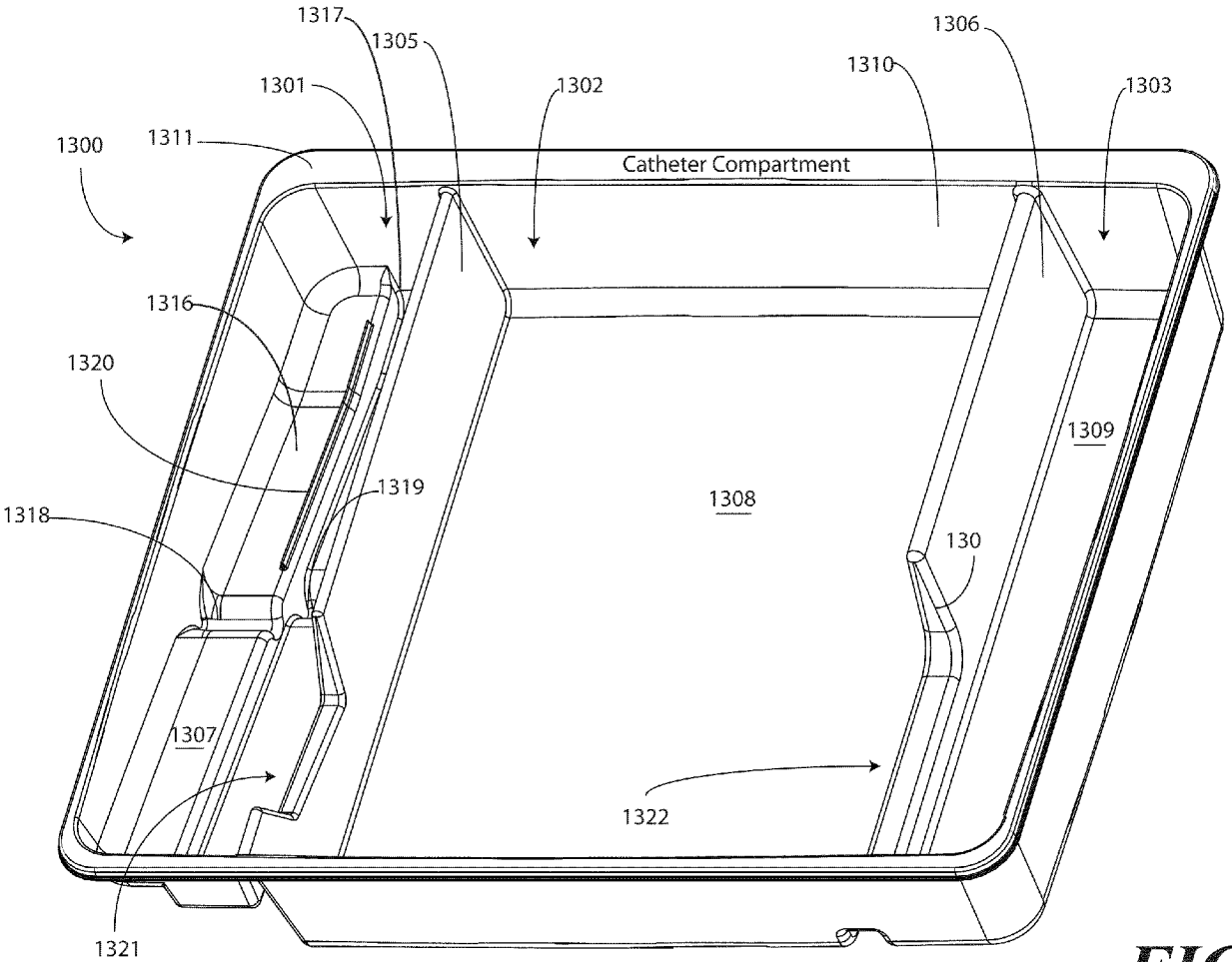
FIG. 13 illustrates one embodiment of contours, compartments, and barriers that can be included with trays in accordance with embodiments of the invention.

As noted above, either or both of the trays, in any of the embodiments above, can include contours, compartments, and barriers. Turning now to FIG. 13, illustrated therein is one tray that demonstrates some of the possible contours, barriers, compartments, and so forth. FIG. 13 is intended to show some possibilities, but is not intended to be limiting. Various different combinations of contours, compartments, and barriers can be used, depending upon application. In addition, contours, compartments, and barriers other than those shown in FIG. 13 will be obvious to those of ordinary skill in the art having the benefit of this disclosure.

FIG. 13 illustrates a top, front right perspective view of the illustrative tray 1300. The tray 1300, in one embodiment, is formed by a contoured surface 1304 that demonstrates some of the many various features and compartments that can be included with trays configured in accordance with embodiments of the invention.

The illustrative tray 1300 of FIG. 13 shows three main compartments: a first compartment 1301, a second compartment 1302, and a third compartment 1303. The first compartment 1301 is separated from the second compartment 1302 by a first barrier 1305. The second compartment 1302 is separated from the third compartment 1303 by a second barrier 1306.

In one embodiment, the compartments are open through an opening in the top of the tray 1300—the opening being opposite the base member of the tray 1300, which is formed a first base member 1307, a second base member 1308, and a third base member 1309. The compartments are bounded on the sides by a perimeter wall 1310. In the illustrative "open top" embodiment of FIG. 13, the perimeter wall 1310 ends in a horizontal flange 1311 extending substantially orthogonally from the perimeter wall 1310. It will be clear to those of ordinary skill in the art having the benefit of this disclosure that embodiments other than that shown in FIG. 13 are possible without departing from the spirit and scope of the invention.

In one illustrative embodiment, the various contours, compartments, and barriers of the tray 1300 can be tailored to hold or otherwise accommodate implements and materials needed to perform a catheter-based procedure on a patient. As noted above, in one embodiment the tray 1300 is configured such that these objects are ordered in accordance with their use during the procedure.

To illustrate some of the various possibilities for tray contours, in FIG. 13 the first compartment base member 1307 includes a stair-stepped contour suitable for accommodating a plurality of syringes at different heights. For example, a first step portion 1316 of the stair-stepped contour may be at a different height within the tray 1300 than a second step portion 1317 of the stair-stepped contour.

This stair-stepped contour 1315 can be used as mnemonic device when multiple syringes are stored within the first compartment 1201. For example, it may be intuitive that a syringe placed on a higher step portion may need to be used first. This intuition is further enforced when the higher step portion is disposed farther to the left in a left-to-right usage configuration. Thus, a user receives a mnemonic reminder to use a syringe disposed on the first step portion 1316 prior to a syringe disposed on the second step portion 1317, as it is both higher and farther to the left.

The first compartment base member 1307 can further be configured for syringe ease of use. For example, in one embodiment the first compartment base member 1307 is inclined relative to other compartment base members. As such, the stair-stepped contour forms a ramp upon which syringes may be placed so that the plunger of each syringe is predisposed to project upward and out of the tray 1300. This configuration makes it easier for a medical services provider to grasp the syringes and remove them from the tray 1300.

The first compartment base member 1307 may include other features suitable for accommodating one or more syringes as well. In one embodiment, one or both of the first step portion 1316 and second step portion 1317 can include recesses 1318,1319 for accommodating a syringe flange. These recesses 1318,1319, where employed, generally function to prevent the syringes from sliding lengthwise within the first compartment 1301. Similarly, in one embodiment one or both of the first step portion 1316 and the second step portion 1317 can include protrusions 1320 that help to prevent the syringes from sliding laterally within the first compartment 1301.

In one embodiment, one or both of the first barrier 1305 and the second barrier 1306 include openings disposed therein. In the illustrative embodiment shown in FIG. 13, the first barrier 1305 includes a first opening 1321 between the first compartment 1301 and the second compartment 1302. Similarly, the second barrier 1306 includes a second opening 1322 between the second compartment 1302 and the third compartment 1303. Each of these openings has an opening depth associated therewith. While the opening depths can be the same, in one embodiment the opening depths are different. For example, in the illustrative embodiment of FIG. 13, the first opening 1321 has a first opening depth that is less than the second opening depth of the second opening 1322. Similarly, in one embodiment the opening widths can be the same or different.

Such a disparity in opening depths and widths, as well as the inclusion of inclined opening side members, provides an advantage in some applications. For instance, as noted above, in many catheter procedures a pair of syringes—such as syringes having a one-half inch diameter—fits easily into the first compartment 1301 when the tray 1300 is made with the illustrative dimensions set forth above. However, some procedures require one or more of the syringes to be larger. For example, some syringes are larger in diameter. These larger syringes are capable of nesting within the first opening 1321 and second opening 1322.

Next, as described above with respect to the embodiment of FIG. 9, one tray can be used as a lubricating well for a catheter assembly stored in the other tray. In some applications, it may be desirable to lubricate the catheter in a single tray, without passing it between trays. In such applications, the stair-stepped contour 1315, working in tandem with the first opening 1321 can be used as a lubricant applicator for the catheter.

Illustrating by way of example, the medical services provider may dispense lubricating jelly along the second step portion 1317. As the second step portion 1317 is lower in the tray 1300 than the first step portion 1316, the second step portion 1317 serves as a channel in which the lubricating jelly may spread. A medical services provider may then pass the catheter tubing through the first opening 1321, through the channel formed by the second step portion 1317, i.e., along the second step portion 1317 through the dispensed lubricating jelly, and out the top of the tray 1300 to the patient. This feature of the tray 1300 greatly eases the application of lubricating jelly to the catheter in a single tray application. This feature also permits lubrication of the catheter while keeping the catheter within the tray 1300. The ability to keep the catheter in the tray 1300 reduces the risk that the catheter or corresponding devices will be contaminated with bacteria or microbes on other objects within the procedure room. For example, when the first compartment 1301 is used to apply lubricating jelly to the catheter, the lubricating jelly can be applied while the catheter is contained within the tray 1300, thereby reducing the risk that the catheter will become contaminated, just as was the case with the embodiment of FIG. 9 described above. This correspondingly reduces the risk of infection for the patient receiving the catheter.

Graphical indicia can be printed, placed upon, or molded into the horizontal flange 1311. In one embodiment, compartment designations can be placed above each compartment to ensure the medical services provider uses the correct device or material at the correct time. In another embodiment, expiratory dates for materials or devices disposed within the tray 1300 may be placed on the horizontal flange 1311. It will be obvious to those of ordinary skill in the art having the benefit of this disclosure that the invention is not so limited. Any number of various text or picture combinations can be printed on, placed upon, or molded into various parts of the tray. For instance, graphical indicia can be applied to the compartment base members in addition to the horizontal flange 1311. Note that the horizontal flanges, in one embodiment, can terminate in downwardly protruding vertical flanges for increased stability during the printing process.

Figure 14:
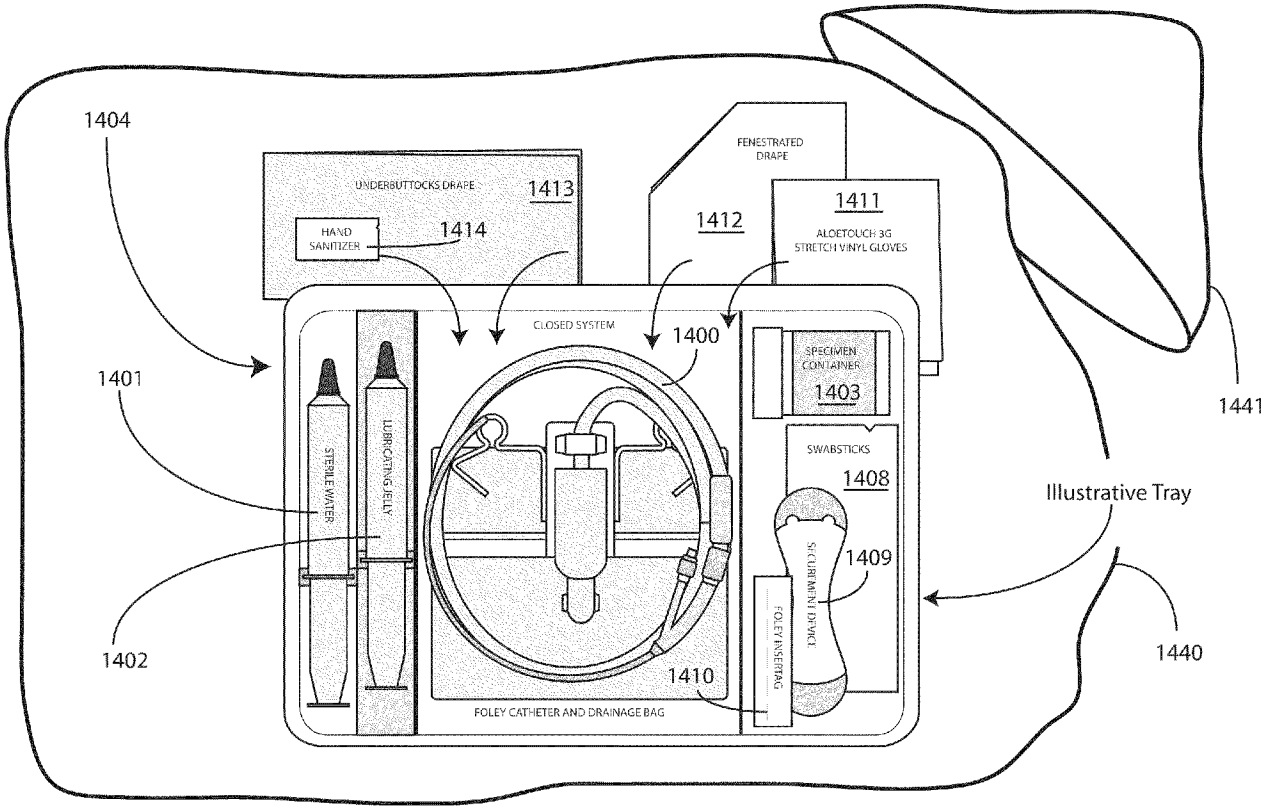
FIG. 14 illustrates some of the implements that may be stored within trays in accordance with embodiments of the invention.

Turning now to FIG. 14, illustrated therein is an exemplary representation of some of the various implements that can be included within trays for performing catheterization procedures in accordance with embodiments of the invention. As noted above, instructions can be disposed within the trays as well. In one embodiment, a pictorial representation of the contents can be included on the instruction booklet.

The medical devices and implements for performing a catheterization procedure shown in this illustrative embodiment include a pair of syringes 1401,1402 and a specimen container 1403. Additionally swab sticks 1408, a catheter securement device 1409, a Foley insert tag 1410, vinyl gloves 1411, a fenestrated drape 1412, an underbuttocks drape 1413, and a hand sanitizer 1414 solution or wipe can be disposed within one of the trays.

When two trays are stacked, they can be placed upon and wrapped within one or more layers of wrap material 1440 that creates a sterilization barrier. In one embodiment, the wrap material 1440 can be CSR wrap. A CSR wrap is one embodiment for the wrap, it will be understood by those of ordinary skill in the art having the benefit of this disclosure that other materials may also be used as the sterilization barrier. Such materials include spunbond-meltblown-spunbond (SMS) wrap, tissue-poly-tissue wraps, tissue-poly wraps, and so forth. For example, in an illustrative embodiment, the wrap material 1440 comprises a white layer of sterilization wrap measuring 24 inches square.

Providing the wrap material 1440 can be advantageous in many applications. For example, when the wrap material 1440 is a medically usable material, such as CSR wrap, a medical services provider may unfold the wrap about the trays 1404, prior to transitioning them from a two-layer, stacked configuration to a single-layer, side-by-side configuration, to create a sterile field for the catheterization procedure. For this reason, one or more layers of wrap material 1440 can be simply folded about the trays 1404 prior to sealing them in a sealed bag 1441.

Turning now to FIGS. 15, 16, 17, and 18 illustrated therein is one embodiment of a method of using a packaged catheter assembly 1501 configured in accordance with embodiments of the invention. At FIG. 15, a health care services provider 1502 opens an outer bag 1503 that is disposed about the trays 1504, which are configured in the stacked configuration. The health care services provider 1502 then removes the bag 1503 to reveal the stacked configuration therein.

The health care services provider 1502 can then unfold the one or more layers of wrap material 1505. Where an additional layer of wrap material 1506 is included, this unfolding step reveals and makes accessible the additional layer of wrap material 1506, which is an under-buttocks drape in one embodiment.

In one embodiment 1506 the under-buttocks drape is contained completely within the sterile wrap and within the tray itself. In this case the tray is unwrapped completely and the drape 1506 is removed and placed into position. In another embodiment the drape is located outside of the sterile field comprised of the CSR wrap, or within the folds of the sterile wrap and is placed in position relative toe the patient prior to completely unwrapping the tray.

Figures 15, 16, 17, 18:
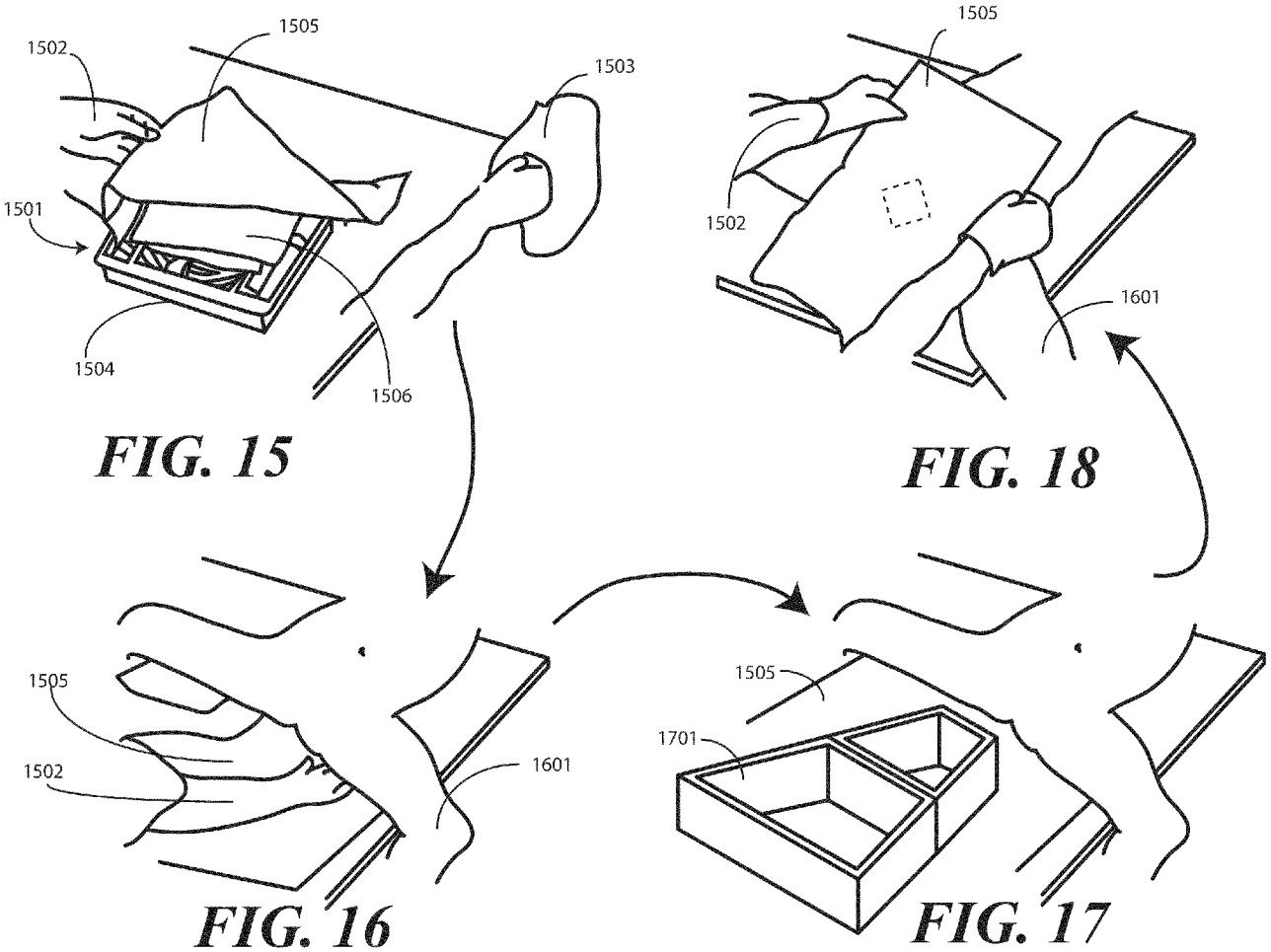
FIGS. 15-18 illustrate a method for using trays configured in accordance with embodiments of the invention.

As noted above, in one embodiment the one or more layers of wrap material 1505 can be unfolded to form a sterile field. Turning now to FIG. 16, illustrated therein is a step of the method that utilizes this sterile field. Specifically, in FIG. 16 the health care services provider 1502 places the wrap material 1505, configured here as an under-buttocks drape, beneath the patient 1601, to keep unwanted fluids from contacting the surface below the patent such as a bed or operating table for example.

Turning now to FIG. 17, as illustrated therein, the health care services provider has transformed the stacked trays (1504) from a two-layer, stacked configuration to a single-layer, side-by-side configuration 1701. Further, the health care services provider has placed the single-layer, side-by-side configuration 1701 on the one or more layers of wrap material 1505, thereby keeping all of the implements needed for the catheterization procedure nicely within the sterile field.

Turning now to FIG. 18, illustrated therein is a step of the method that may be used when an additional layer of wrap material 1506 is included with the packaged catheter assembly. In FIG. 18, the health care services provider 1502 is placing the optional drape 1505 atop the patient 1601. Note that in the illustrative embodiment of FIG. 18, the additional layer of wrap material 1505 is fenestrated, in that it includes a perforated opening suitable for performing a catheterization procedure.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims.

What is claimed is:

1. A method of using a catheter package assembly, the method comprising:

providing the catheter package assembly, the catheter package assembly comprising:

a first tray having a first tray opening, a first tray base member, and first tray sidewalls;

a second tray having a second tray opening, a second tray base member and second tray sidewalls; and a mechanical feature coupling the first tray and the second tray, the mechanical feature configured to permit each of the first tray and the second tray to transition from a two-layer, stacked configuration where the first tray base member is between the first tray opening and the second tray opening, to a single-layer, side-by-side configuration without inversion;

one or more layers of wrap folded about the first tray and the second tray so as to enclose the first tray and the second tray within the one or more layers of wrap; and a sealed bag disposed about the first tray and the second tray;

unsealing the sealed bag disposed about the first tray and the second tray to reveal the one or more layers of wrap folded about the first tray and the second tray;

unfolding the one or more layers of wrap to create a sterile field about the first tray and the second tray; and transitioning the first tray and the second tray from the two-layer, stacked configuration to the single-layer, side-by-side configuration.

2. The method of claim 1, further comprising:

obtaining an underbuttocks wrap from the catheter package assembly; and placing the underbuttocks wrap beneath a patient.

3. The method of claim 1, further comprising placing the single-layer, side-by-side configuration between a patient's legs atop the one or more layers of wrap.

4. The method of claim 1, the mechanical feature configured to couple the first tray and the second tray together when arranged as the single layer, side-by-side configuration.

5. The method of claim 4, wherein the providing the mechanical feature comprises providing a pivot and slide mechanism.

6. The method of claim 4, wherein the providing the mechanical feature comprises providing a link and track mechanism.

7. The method of claim 4, wherein the providing the mechanical feature comprises providing one or more arm hinges.

8. The method of claim 1, wherein the transitioning occurs without inversion of either the first tray or the second tray.

9. The method of claim 1, further comprising providing a retention mechanism configured to selectively retain the first tray and the second tray in the single layer, side-by-side configuration.

10. The method of claim 1, further comprising providing a contour along a portion of a base member of one or both of the first tray and the second tray.

* * * * *